US011095042B1

(12) United States Patent
Thacker et al.

(10) Patent No.: US 11,095,042 B1
(45) Date of Patent: Aug. 17, 2021

(54) PERIODIC TAPERED STRUCTURE

(71) Applicant: The Boeing Company, Chicago, IL (US)

(72) Inventors: Corey McKinney Thacker, Madison, AL (US); Enrique Jesus Ruiz, Meridianville, AL (US); Preston Tyler Bushey, Huntsville, AL (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 16/789,593

(22) Filed: Feb. 13, 2020

(51) Int. Cl.

| | |
|---|---|
| ***H01Q 21/22*** | (2006.01) |
| ***H01Q 1/12*** | (2006.01) |
| ***H01Q 1/42*** | (2006.01) |
| ***H01Q 9/04*** | (2006.01) |

(52) U.S. Cl.
CPC ..... *H01Q 21/22* (2013.01); *H01Q 1/12* (2013.01); *H01Q 1/422* (2013.01); *H01Q 9/0485* (2013.01)

(58) Field of Classification Search
CPC ..... H01Q 21/22; H01Q 1/12; H01Q 1/422; H01Q 9/0485
USPC ..... 343/855, 850, 872
See application file for complete search history.

(56) References Cited

U.S. PATENT DOCUMENTS

| | | | | |
|---|---|---|---|---|
| 5,607,631 | A * | 3/1997 | Wolfson | H01P 1/181 264/138 |
| 2010/0225563 | A1* | 9/2010 | Lin | H01Q 15/24 343/909 |
| 2014/0132473 | A1* | 5/2014 | Isom | H01Q 21/0006 343/855 |
| 2018/0294449 | A1* | 10/2018 | Zeng | H01M 10/625 |
| 2019/0140362 | A1* | 5/2019 | Edenfield | H01Q 3/34 |
| 2019/0190140 | A1* | 6/2019 | Lavin | H01Q 9/0485 |
| 2019/0252753 | A1* | 8/2019 | Ashida | H01P 1/2088 |
| 2019/0280354 | A1* | 9/2019 | Schlak | H01M 10/6551 |
| 2020/0006652 | A1* | 1/2020 | Cheng | H01L 45/14 |
| 2020/0112084 | A1* | 4/2020 | Edenfield | H01Q 1/2283 |

* cited by examiner

*Primary Examiner* — Lam T Mai
(74) *Attorney, Agent, or Firm* — Bell & Manning, LLC

(57) ABSTRACT

A dielectric element includes a bottom surface, a top surface, and a plurality of cells formed vertically between the bottom surface and the top surface. Each cell of the plurality of cells includes a cell sidewall that extends below the top surface toward the bottom surface. The cell sidewall forms an aperture in the top surface and tapers from the top surface toward a center of a respective cell. Each cell sidewall is formed of a dielectric material.

20 Claims, 24 Drawing Sheets

PERIODIC TAPERED STRUCTURE

BACKGROUND

Electromagnetic waves do not perform well with abrupt changes in characteristic impedance because, when a propagating wave encounters a sudden change in the medium, a reflection is generated. Part of the received power is absorbed by the receiver and the rest is lost to the reflection. This has reduced the performance of antennas that are dielectrically loaded for miniaturization because, even when tuned at the proper frequency, the efficiency of the antenna is lowered due to the dielectric loading.

SUMMARY

In an illustrative embodiment, a dielectric element is provided. The dielectric element includes, but is not limited to, a bottom surface, a top surface, and a plurality of cells formed vertically between the bottom surface and the top surface. Each cell of the plurality of cells includes a cell sidewall that extends below the top surface toward the bottom surface. The cell sidewall forms an aperture in the top surface and tapers from the top surface toward a center of a respective cell. Each cell sidewall is formed of a dielectric material.

In another illustrative embodiment, an antenna is provided. The antenna includes, but is not limited to, dielectric element, a conductive layer, a conducting pattern layer, and a plurality of vertical interconnect accesses (vias). The conductive layer includes, but is not limited to, a top conductive surface and a bottom conductive surface. The top conductive surface is on an opposite side of the first conductive layer relative to the bottom conductive surface and is mounted to the bottom surface of the dielectric element. The conductive layer is formed of a first conductive material. The conducting pattern layer is mounted to the top surface of the dielectric element and is formed of a second conductive material. Each vertical interconnect access (via) of the plurality of vias is formed of a third conductive material that extends through the dielectric element from the bottom surface to the top surface. Each via of the plurality of vias is connected to the conducting pattern layer. A first via may provide a first voltage value to the conducting pattern layer, and a second via may provide a second voltage value different than the first voltage value to the conducting pattern layer.

In another illustrative embodiment, a phased array antenna is provided. The phased array antenna includes, but is not limited to, a transmitter and a plurality of antennas mounted to a surface to form an array. Each antenna of the plurality of antennas is mounted to receive electrical energy from the transmitter.

Other principal features of the disclosed subject matter will become apparent to those skilled in the art upon review of the following drawings, the detailed description, and the appended claims.

BRIEF DESCRIPTION OF THE DRAWINGS

Illustrative embodiments of the disclosed subject matter will hereafter be described referring to the accompanying drawings, wherein like numerals denote like elements.

DETAILED DESCRIPTION

Figure 1:
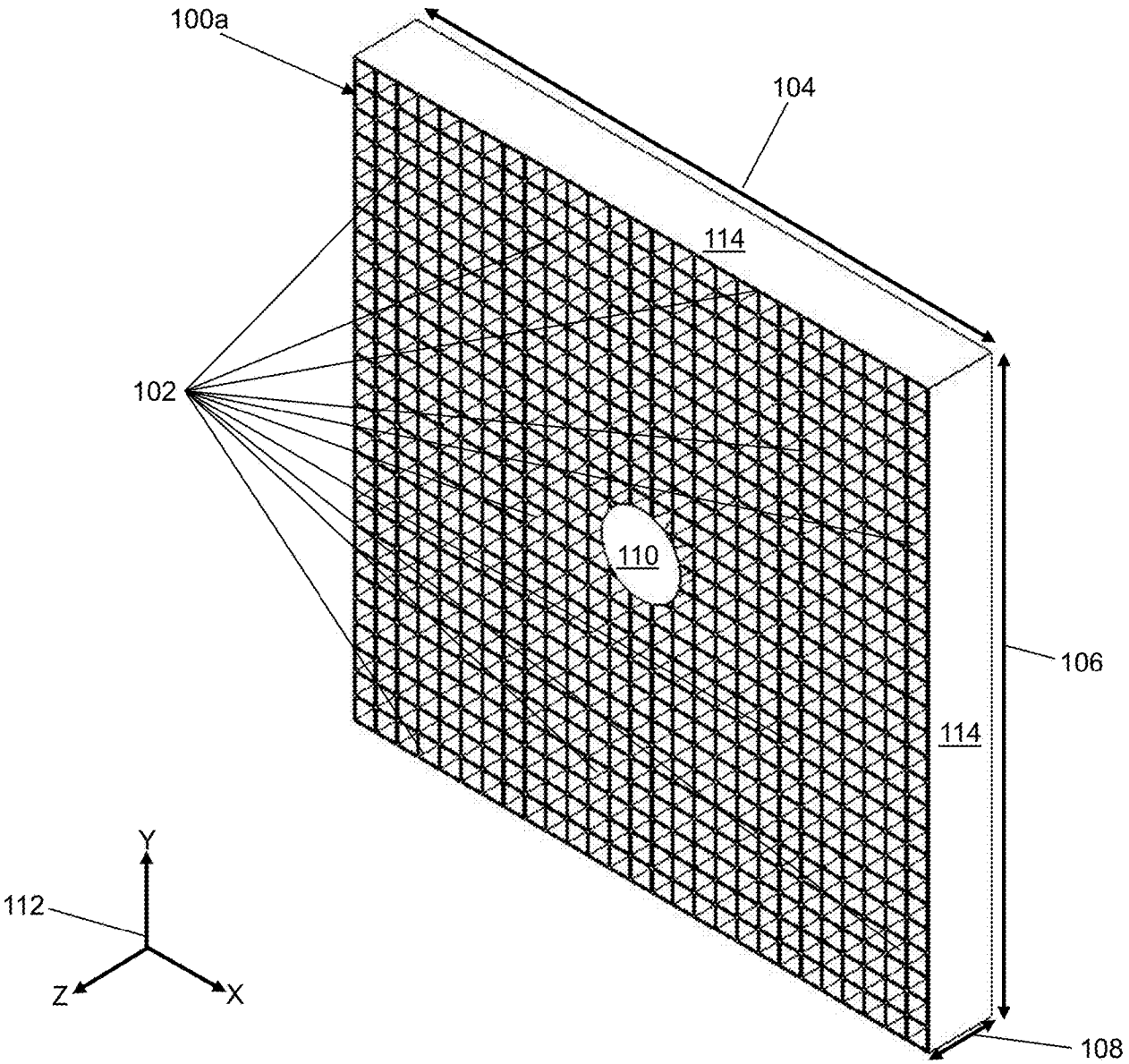
FIG. 1 depicts a perspective side view of a first dielectric element in accordance with an illustrative embodiment.
Figure 2:
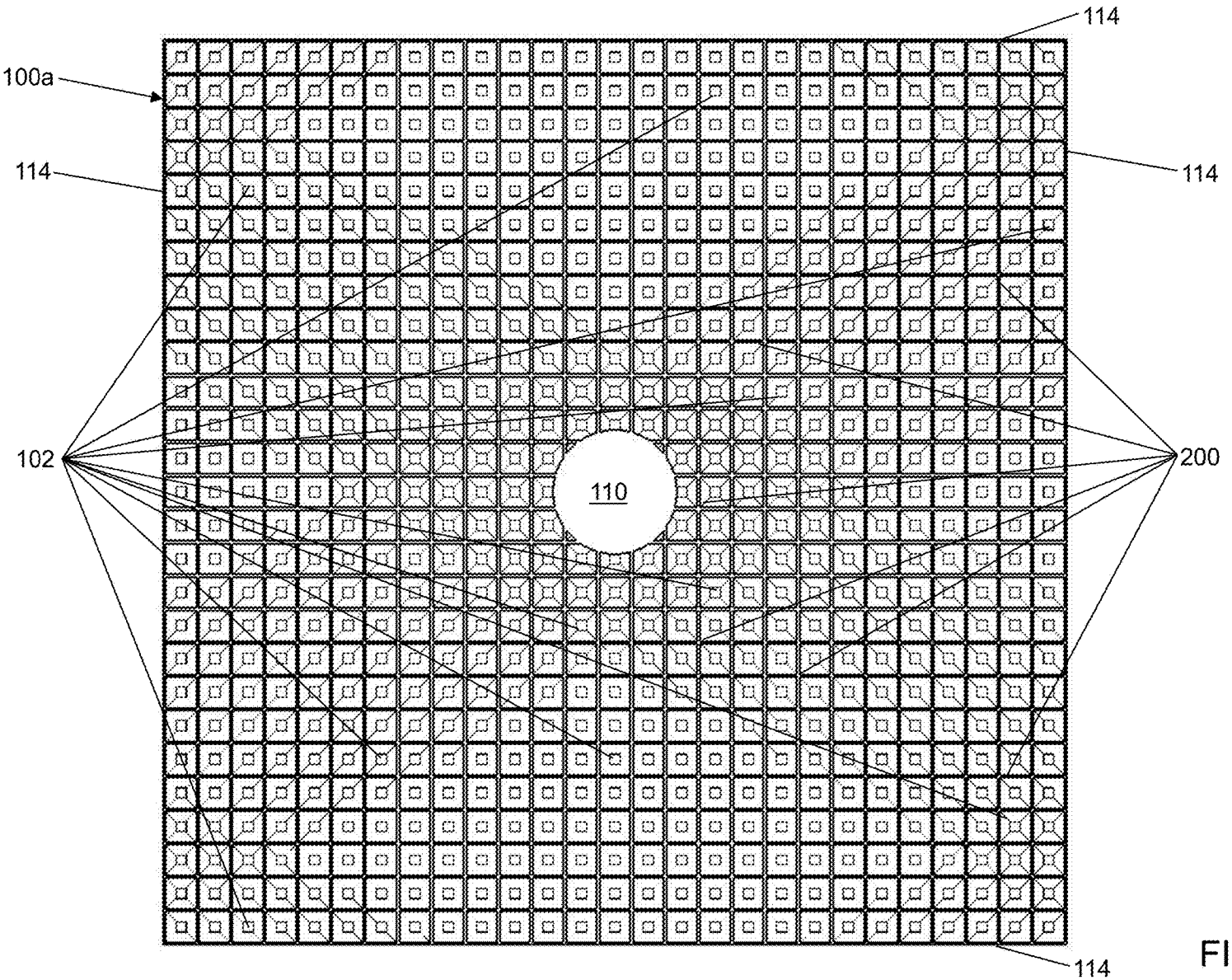
FIG. 2 depicts a top view of the first dielectric element of FIG. 1 in accordance with an illustrative embodiment.
Figure 3:
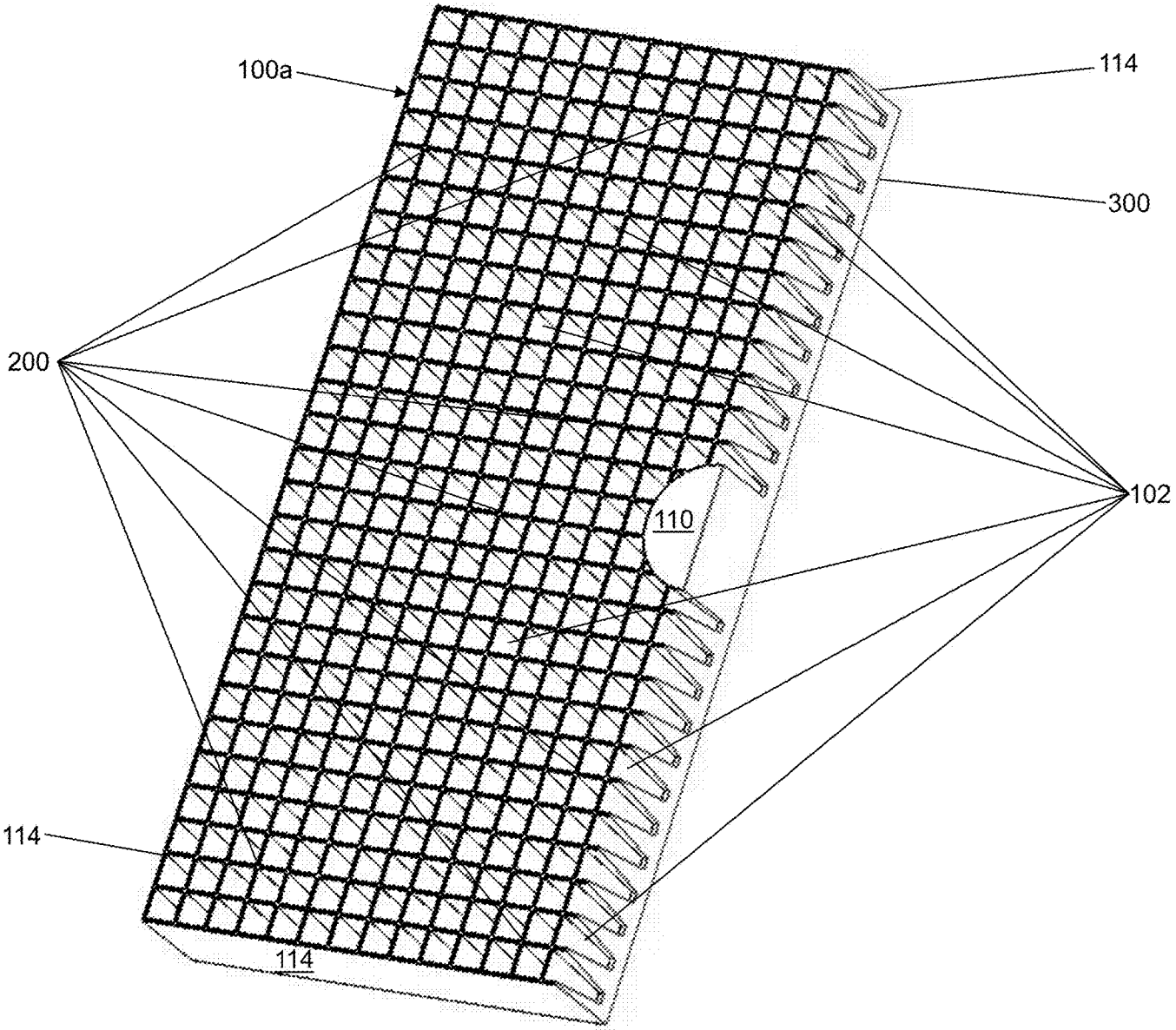
FIG. 3 depicts a perspective side cross-sectional view of the first dielectric element of FIG. 1 in accordance with an illustrative embodiment.
Figure 4:
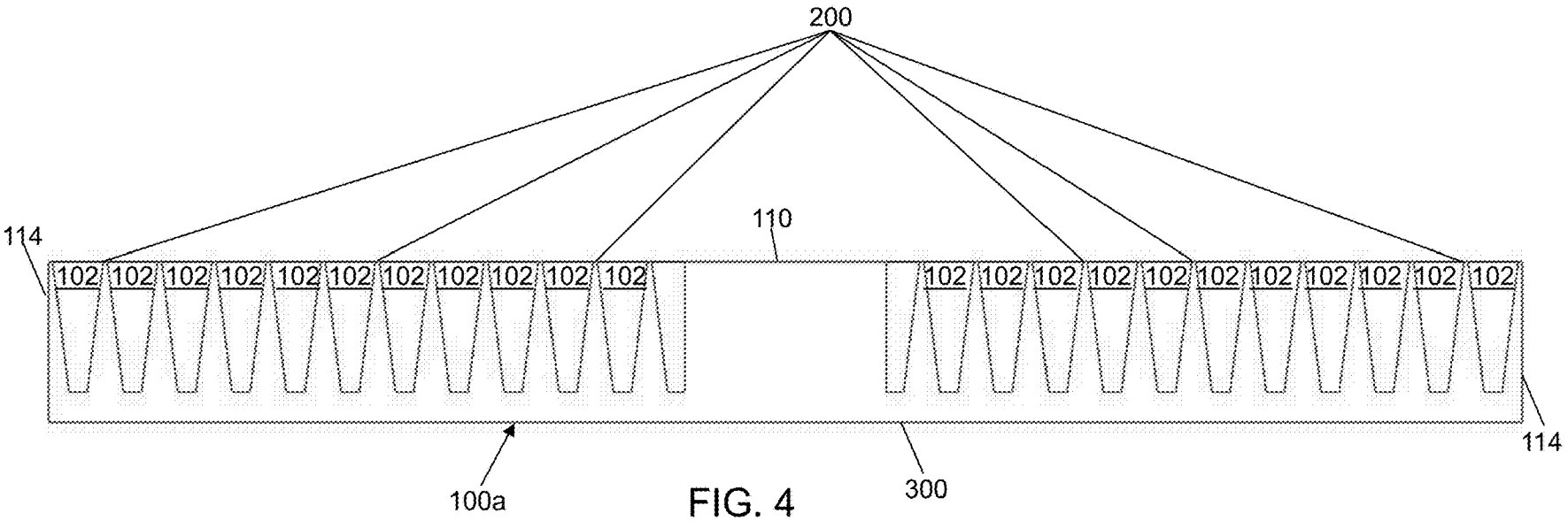
FIG. 4 depicts a side cross-sectional view of the first dielectric element of FIG. 1 in accordance with an illustrative embodiment.
Figure 5:
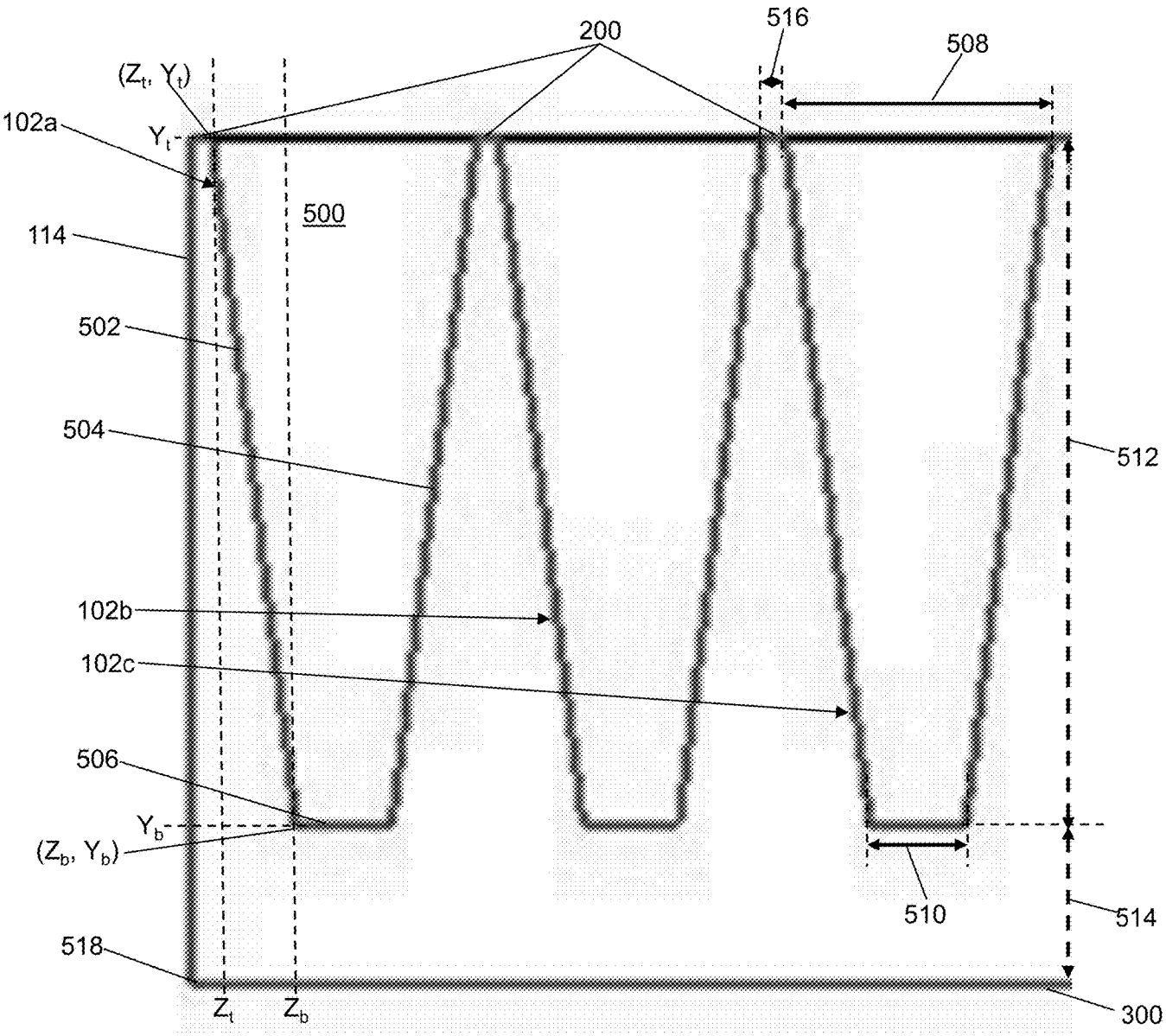
FIG. 5 depicts a zoomed side cross-sectional view of the first dielectric element of FIG. 1 in accordance with an illustrative embodiment.

Referring to FIG. 1, a perspective side view of a first dielectric element 100*a* is shown in accordance with an illustrative embodiment. Referring to FIG. 2, a top view of first dielectric element 100*a* is shown in accordance with an illustrative embodiment. Referring to FIG. 3, a perspective side cross-sectional view of first dielectric element 100*a* is shown in accordance with an illustrative embodiment. Referring to FIG. 4, a side cross-sectional view of first dielectric element 100*a* is shown in accordance with an illustrative embodiment. Referring to FIG. 5, a zoomed side cross-sectional view of first dielectric element 100*a* is shown in accordance with an illustrative embodiment.

First dielectric element 100*a* may include a first plurality of cells 102. In the illustrative embodiment of FIGS. 1 to 5, the first plurality of cells 102 form a square grid of cells in an x-y plane as defined in an x-y-z coordinate reference frame 112. A depth direction is parallel to a z-axis of x-y-z coordinate reference frame 112, where an x-axis is perpendicular to a y-axis of x-y-z coordinate reference frame 112, and both the x-axis and the y-axis are perpendicular to the z-axis to form a right-handed coordinate system. In the illustrative embodiment of FIGS. 1 to 5, first dielectric element 100*a* has a square cross-sectional shape in the x-y plane though first dielectric element 100*a* may form other shapes in the x-y plane including a triangle, a circle, an ellipse, other polygons, etc.

Each cell of the first plurality of cells 102 is defined by one or more walls. First dielectric element 100*a* may include a top surface 200 defined between a top of the walls of each cell of the first plurality of cells 102, a bottom surface 300 defined between a bottom of the walls of each cell of the first plurality of cells 102, and one or more element sidewalls 114 formed between top surface 200 and bottom surface 300. In the illustrative embodiment of FIGS. 1 to 5, the one or more element sidewalls 114 include four sidewalls. The four sidewalls of first dielectric element 100*a* have a width 104 in the x-axis direction, a height 106 in the y-axis direction, and a depth 108 in the z-axis direction.

In the illustrative embodiment of FIGS. 1 to 5, each cell of the first plurality of cells 102, such as a first cell 102*a*, a second cell 102*b*, and a third cell 102*c*, has a square cross-sectional shape in the x-y plane though the one or more walls of each cell may form other shapes in the x-y plane including a triangle, a circle, an ellipse, other polygons, etc. In the illustrative embodiment of FIGS. 1 to 5, the first plurality of cells 102 includes a 27×27 grid of cells, where there are 27 cells in the x-axis direction and 27 cells in the y-axis direction though first dielectric element 100*a* may include any number of cells in the x-axis direction and in the y-axis direction with any shape and any size. In the illustrative embodiment of FIGS. 1 to 5, each cell of the first plurality of cells 102 has an identical shape and size though in alternative embodiments, each cell may have a different shape and size. There may be a different number of cells in the x-axis direction than in the y-axis direction.

Referring to FIG. 5, first cell 102*a* has four walls to form the square cross-sectional shape in the x-y plane. For example, first cell 102*a* includes a back wall 500, a left-side wall 502, a right-side wall 504, a front wall (not shown), and a bottom wall 506. Back wall 500, left-side wall 502, right-side wall 504, the front wall, and bottom wall 506 form a conical type structure that forms a top aperture in top surface 200. Again, in the illustrative embodiment, the top aperture has a square cross-sectional shape in the x-y plane for each successive x-y plane defined in the z-direction between top surface 200 and bottom wall 506. Each of back wall 500, left-side wall 502, right-side wall 504, and the front wall has a common slope magnitude though defined relative to different planes parallel to one of the x-z plane or the y-z plane. For example, left-side wall 502 has a slope equal to $(Y_b-Y_t)/(Z_b-Z_t)$ measured from a corner 518.

In the illustrative embodiment, the slope is linear and tapers toward a center of first cell 102*a*. The slope may vary from zero that defines walls that extend straight down towards bottom wall 506 to a large value that generates a shallow depression, though top surface 200 always includes the top aperture for each cell. In alternative embodiments, the slope may be curved. The curve may be described by a polynomial such as the equation for a parabola. The slope further may change at discrete depth values in the z-direction.

Each cell of the first plurality of cells 102 has a top cell width 508, a bottom cell width 510, and a cell depth 512. In the illustrative embodiment, bottom wall 506 is located a depth 514 above bottom surface 300, and each cell is separated from each adjacent cell by a separation width 516. In an alternative embodiment, depth 514 may be zero such that bottom wall 506 is formed by bottom surface 300. In an alternative embodiment, each cell may not include bottom wall 506 but may include a bottom aperture defined through bottom surface 300. Bottom cell width 510 may be approximately zero such that the sidewalls meet at cell depth 512 at a center of the respective cell.

A first pattern layer 110 may be formed on top surface 200 of first dielectric element 100*a*. In the illustrative embodiment, first pattern layer 110 has a circular shape though first pattern layer 110 may form any shape of any size on top surface 200 of first dielectric element 100*a*. In an illustrative embodiment, first pattern layer 110 may be formed of a conductive material such as copper plated steel, silver plated steel, silver plated copper, silver plated copper clad steel, copper, copper clad aluminum, steel, etc., though other materials may be used in alternative embodiments. A size of the top aperture of each cell of the first plurality of cells 102 may be selected to provide a sufficient mechanical support for first pattern layer 110.

In the illustrative embodiments, the exterior walls of first dielectric element 100*a* and the walls of each cell of the first plurality of cells 102 may be formed of one or more dielectric materials that may include foamed polyethylene, solid polyethylene, polyethylene foam, polytetrafluoroethylene, etc. In an alternative embodiment, an element may be formed similar to first dielectric element 100*a* though using a different material such as a type of plastic, metal, etc. The exterior walls of first dielectric element 100*a* and the walls of each cell of the first plurality of cells 102 further may be formed of different materials that change in any of the x-direction, the y-direction, and/or the z-direction. For example, first dielectric element 100*a* may be formed using a 3D printer.

By varying a size of the aperture as each cell progresses downward in the z-direction, the density of the material and hence the effective dielectric constant of the material may slowly vary to avoid an abrupt change in characteristic impedance of the air-substrate boundary above top surface 200. Benefits when first dielectric element 100*a* is used as part of an antenna are an improved return loss reflected by first pattern layer 110, an improved efficiency of the antenna, and a lower weight.

Figure 6:
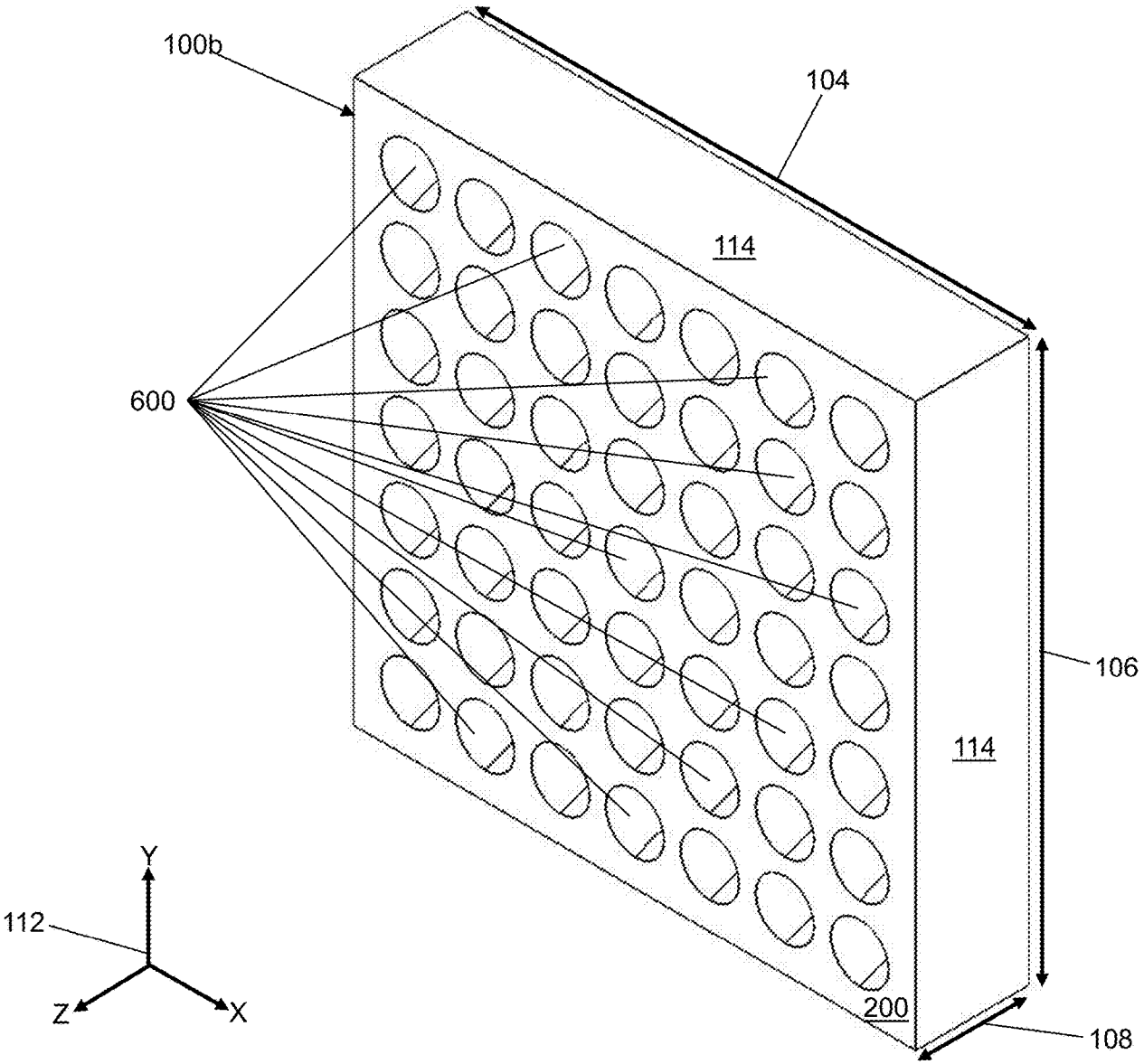
FIG. 6 depicts a perspective side view of a second dielectric element in accordance with an illustrative embodiment.
Figure 7:
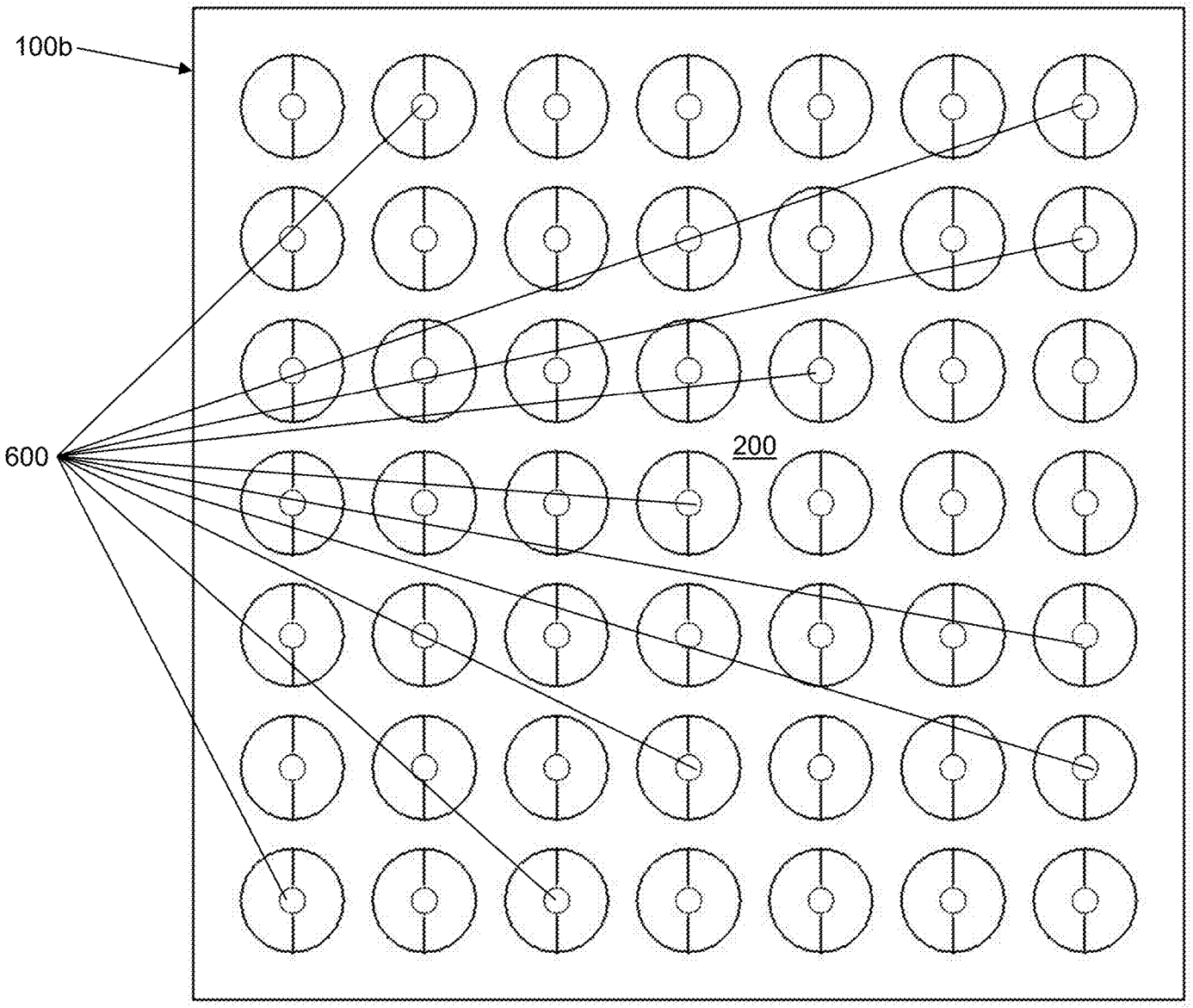
FIG. 7 depicts a top view of the second dielectric element of FIG. 6 in accordance with an illustrative embodiment.
Figure 8:
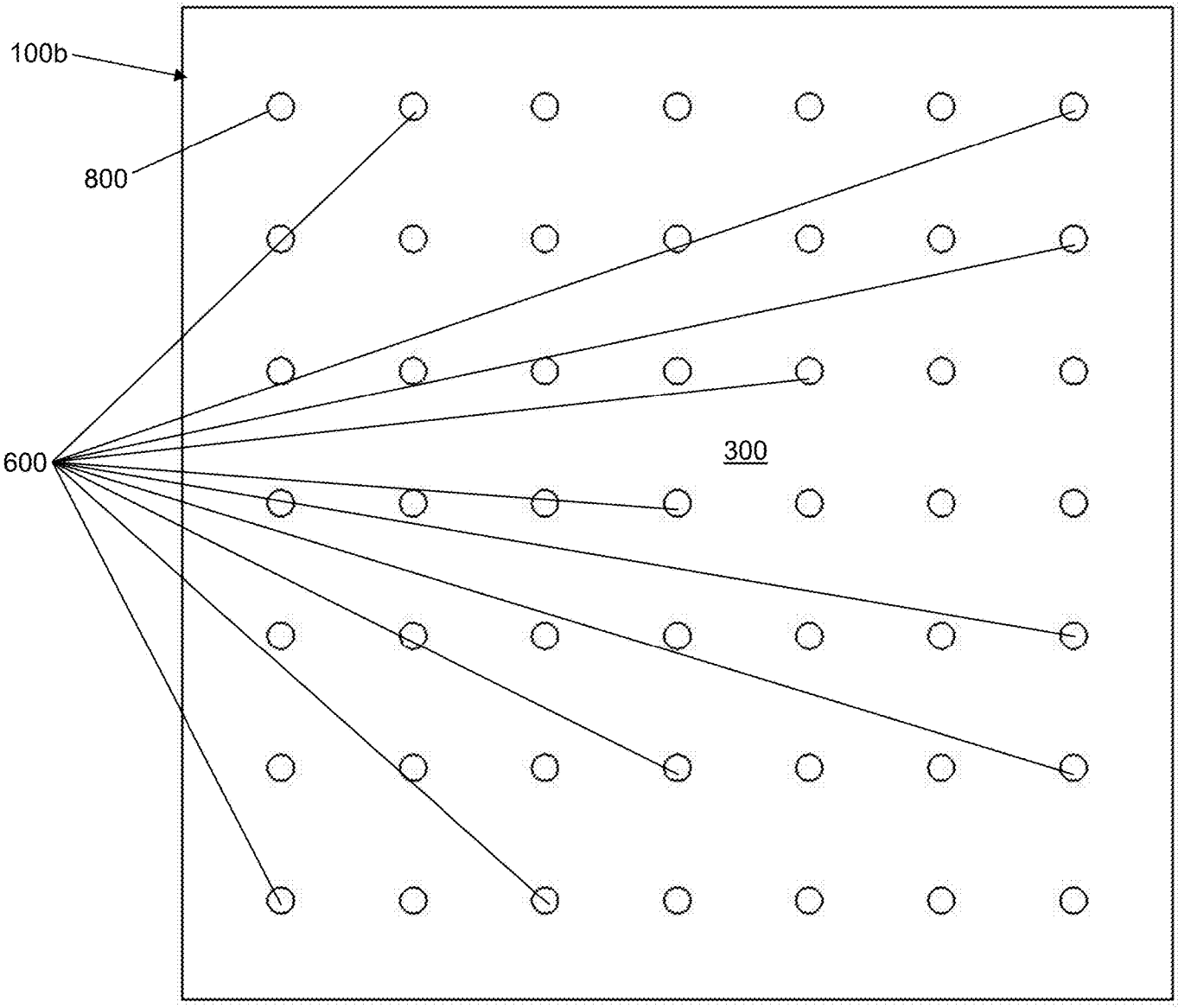
FIG. 8 depicts a bottom view of the second dielectric element of FIG. 6 in accordance with an illustrative embodiment.
Figure 9:
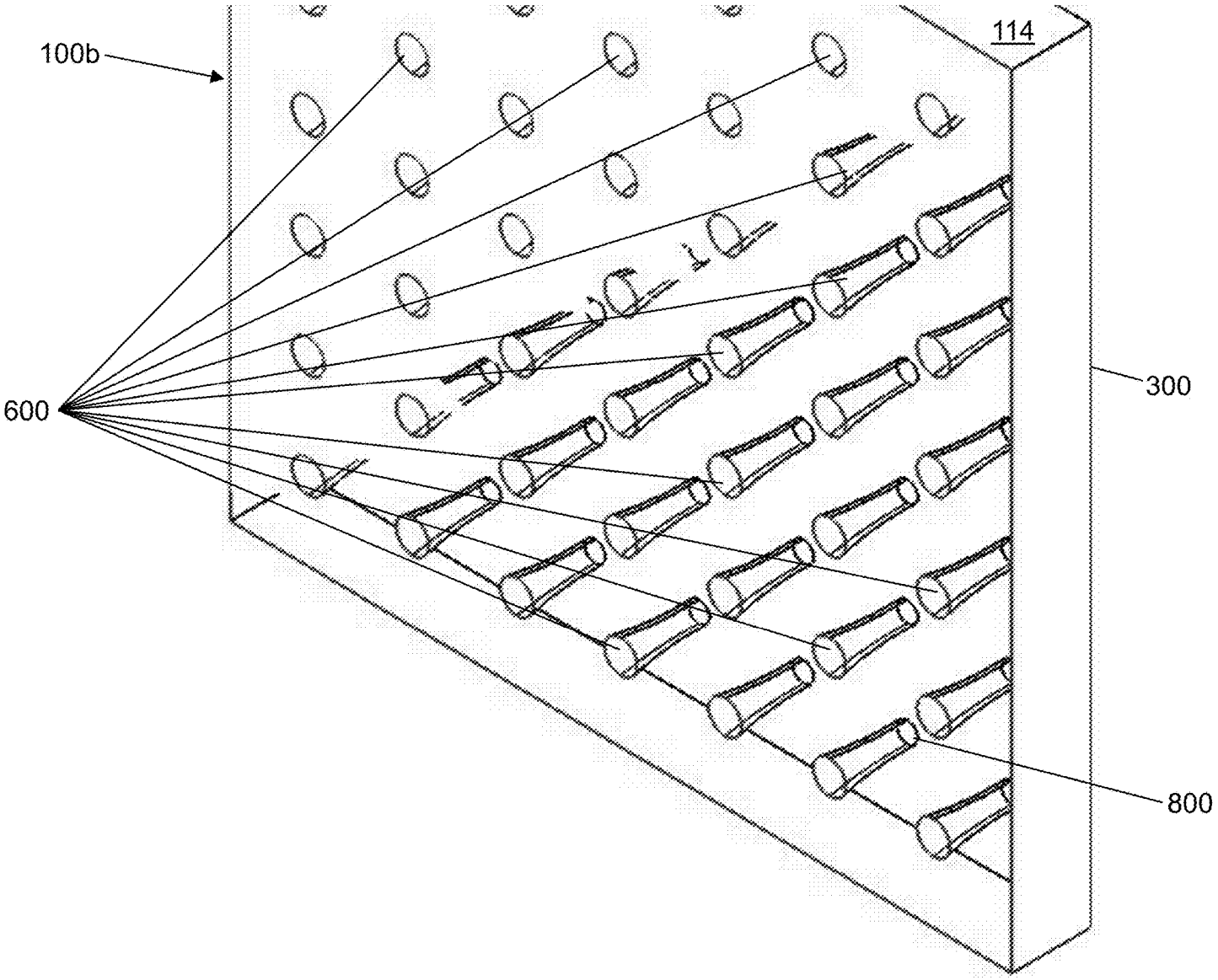
FIG. 9 depicts a perspective top cross-sectional view of the second dielectric element of FIG. 6 in accordance with an illustrative embodiment.
Figure 10:
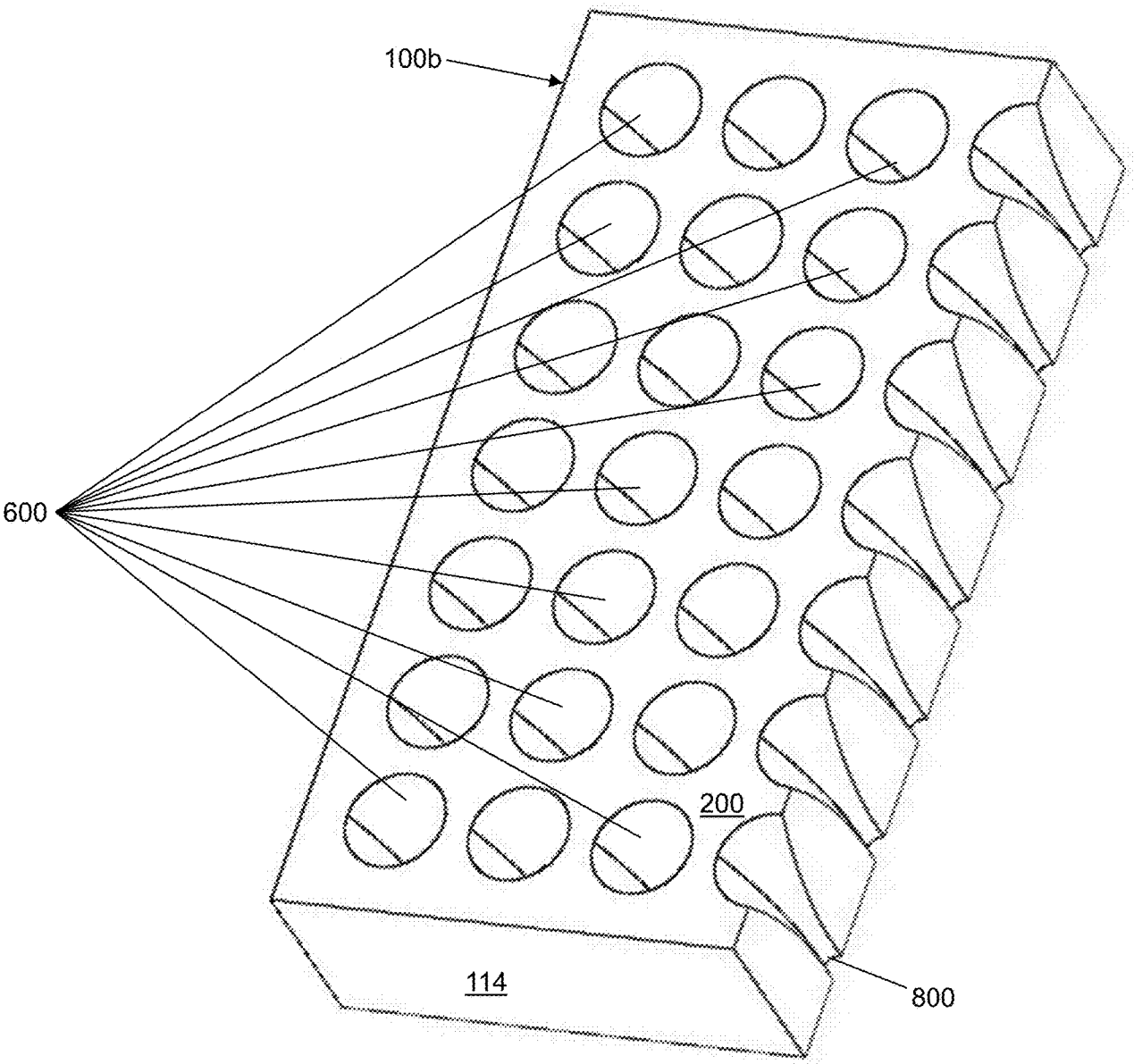
FIG. 10 depicts a perspective side cross-sectional view of the second dielectric element of FIG. 6 in accordance with an illustrative embodiment.
Figure 11:
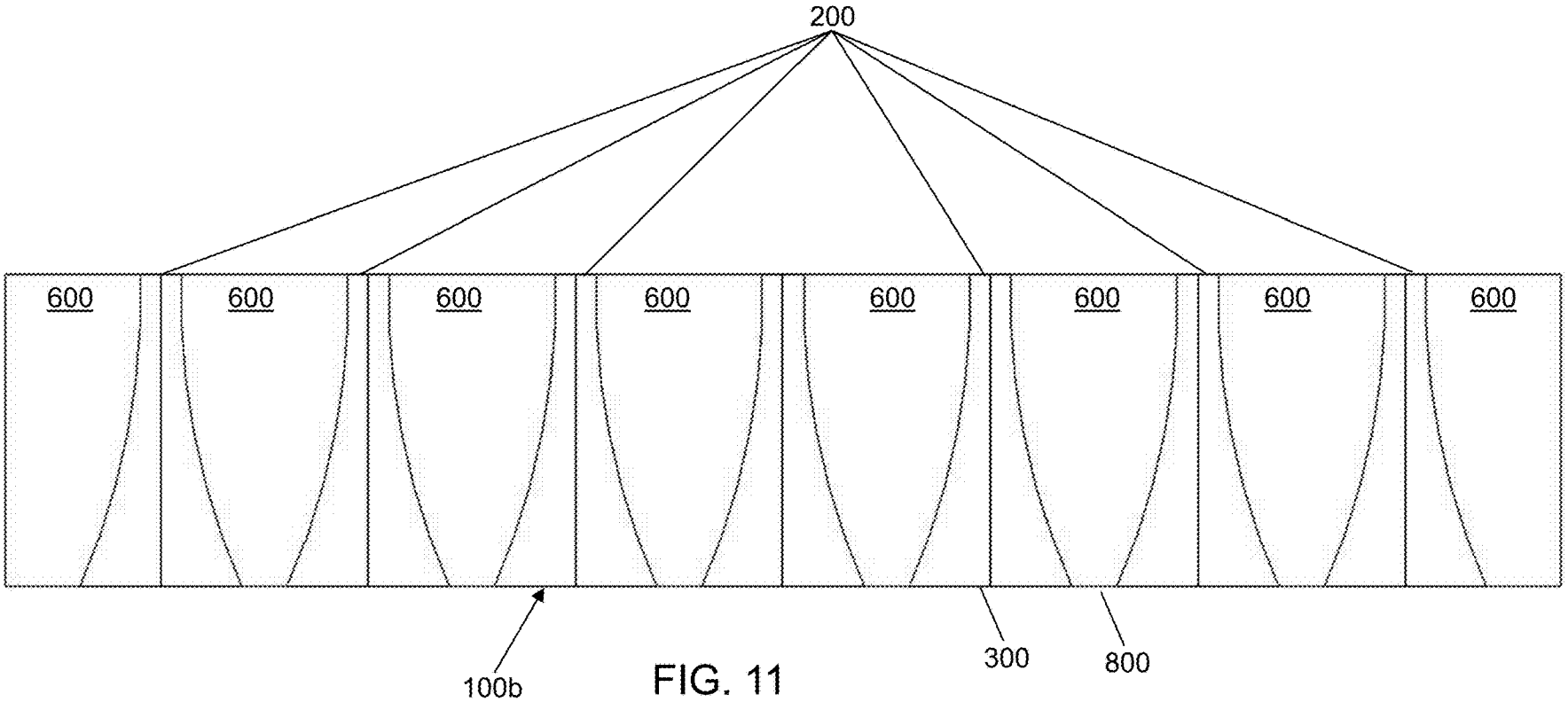
FIG. 11 depicts a side cross-sectional view of the second dielectric element of FIG. 6 in accordance with an illustrative embodiment.
Figure 12:
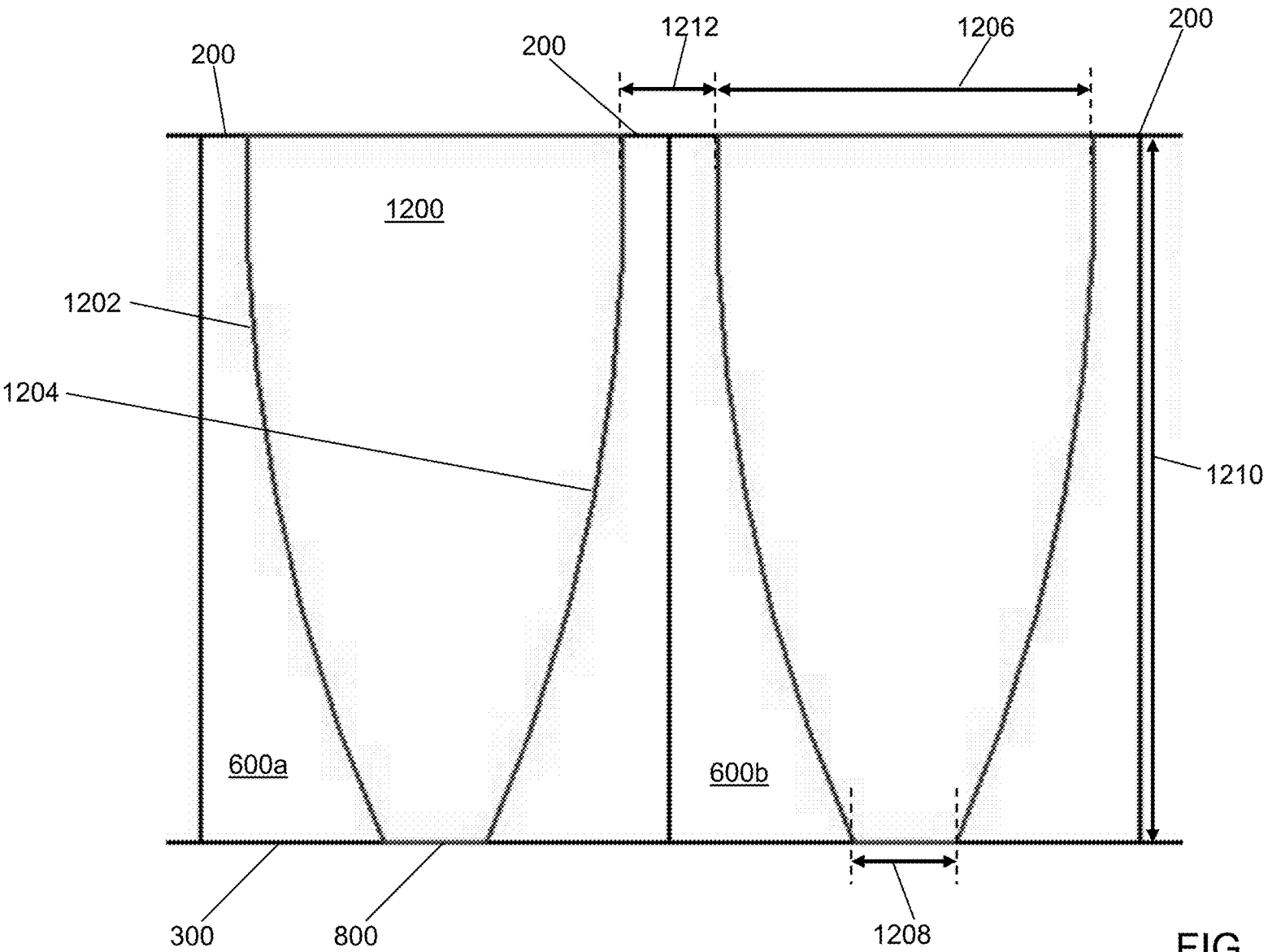
FIG. 12 depicts a zoomed side cross-sectional view of the second dielectric element of FIG. 6 in accordance with an illustrative embodiment.

Referring to FIG. 6, a perspective side view of a second dielectric element 100*b* is shown in accordance with an illustrative embodiment. Referring to FIG. 7, a top view of second dielectric element 100*b* is shown in accordance with an illustrative embodiment. Referring to FIG. 8, a bottom view of second dielectric element 100*b* is shown in accordance with an illustrative embodiment. Referring to FIG. 9 a perspective top cross-sectional view of second dielectric element 100*b* is shown in accordance with an illustrative embodiment. Referring to FIG. 10, a perspective side cross-sectional view of second dielectric element 100*b* is shown in accordance with an illustrative embodiment. Referring to FIG. 11, a side cross-sectional view of second dielectric element 100*b* is shown in accordance with an illustrative embodiment. Referring to FIG. 12, a zoomed side cross-sectional view of second dielectric element 100*b* is shown in accordance with an illustrative embodiment.

Second dielectric element 100*b* is similar to first dielectric element 100*a* though second dielectric element 100*b* includes fewer cells, and the cells have circular apertures in the x-y plane throughout the z-direction. Second dielectric element 100*b* may include a second plurality of cells 600. In the illustrative embodiment of FIGS. 6 to 12, the second plurality of cells 600 form a square grid of cells in the x-y plane as defined in x-y-z coordinate reference frame 112. In the illustrative embodiment of FIGS. 6 to 12, second dielectric element 100*b* has a square cross-sectional shape in the x-y plane though second dielectric element 100*b* may form other shapes in the x-y plane including a triangle, a circle, an ellipse, other polygons, etc.

Each cell of the second plurality of cells 600 is defined by one or more walls. Second dielectric element 100*b* may include top surface 200 defined between a top of the walls of each cell of the second plurality of cells 600, bottom surface 300 defined between a bottom of the walls of each cell of the second plurality of cells 600, and one or more element sidewalls 114 formed between top surface 200 and bottom surface 300. In the illustrative embodiment of FIGS. 6 to 12, the one or more element sidewalls 114 have width 104 in the x-axis direction, height 106 in the y-axis direction, and depth 108 in the z-axis direction.

In the illustrative embodiment of FIGS. 6 to 12, each cell of the second plurality of cells 600, such as a first cell 600*a* and a second cell 600*b*, has a circular cross-sectional shape in the x-y plane though the one or more walls of each cell may form other shapes in the x-y plane including a triangle, a square, an ellipse, other polygons, etc. In the illustrative embodiment of FIGS. 6 to 12, the second plurality of cells 600 includes a 7×7 grid of cells, where there are 7 cells in the x-axis direction and 7 cells in the y-axis direction though second dielectric element 100*b* may include any number of cells in the x-axis direction and in the y-axis direction with any shape and any size. In the illustrative embodiment of FIGS. 6 to 12, each cell of the second plurality of cells 600 has an identical shape and size though in alternative embodiments, each cell may have a different shape and size.

Referring to FIG. 12, first cell 600*a* has four walls to form the continuous circular cross-sectional shape in the x-y plane though the four walls could be described as a single continuous wall without corners. For example, first cell 600*a* includes a back wall 1200, a left-side wall 1202, a right-side wall 1204, and a front wall (not shown). Instead of a bottom wall, first cell 600*a* includes a bottom aperture formed by a bottom aperture wall 800 formed in bottom surface 300. Back wall 1200, left-side wall 1202, right-side wall 1204, and the front wall form a conical type structure that forms the top aperture in top surface 200 and the bottom aperture defined by bottom aperture wall 800 in bottom surface 300. In alternative embodiments, first cell 600*a* may include a bottom wall that is above bottom surface 300. Again, in the illustrative embodiment, the top aperture has a circular cross-sectional shape in the x-y plane for each successive x-y plane defined in the z-direction between top surface 200 and bottom surface 300. A radius of the circular cross-sectional shape in the x-y plane decreases towards bottom surface 300. Each of back wall 1200, left-side wall 1202, right-side wall 1204, and the front wall has a common radius of curvature at each common depth value in the z-direction. In the illustrative embodiment, back wall 1200, left-side wall 1202, right-side wall 1204, and the front wall curve toward a center of first cell 600*a*.

Each cell of the second plurality of cells 600 has a top cell width 1206, a bottom cell width 1208, and a cell depth 1210. In the illustrative embodiment, each cell is separated from each adjacent cell by a separation width 1212.

In the illustrative embodiments, the exterior walls of second dielectric element 100*b* and the walls of each cell of the second plurality of cells 600 may be formed of one or more dielectric materials that may include foamed polyethylene, solid polyethylene, polyethylene foam, polytetrafluoroethylene, etc. In an alternative embodiment, an element may be formed similar to second dielectric element 100*b* though using a different material such as a type of plastic, metal, etc. The exterior walls of second dielectric element 100*b* and the walls of each cell of the second plurality of cells 600 further may be formed of different materials that change in any of the x-direction, the y-direction, and/or the z-direction. For example, second dielectric element 100*b* may be formed using a 3D printer.

By varying a size of the aperture as each cell progresses downward in the z-direction, the density of the material and hence the effective dielectric constant of the material may slowly vary to avoid an abrupt change in characteristic impedance of the air-substrate boundary above top surface 200. Benefits when second dielectric element 100*b* is used as part of an antenna are an improved return loss reflected by first pattern layer 110, an improved efficiency of the antenna, and a lower weight.

Figure 13:
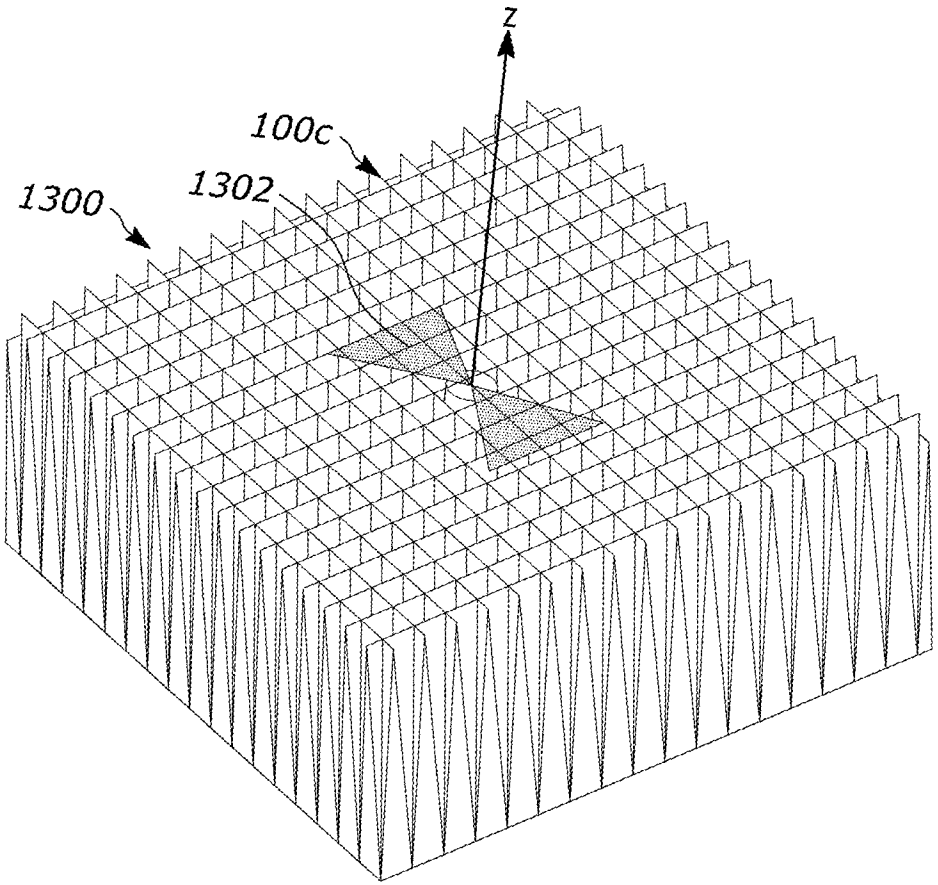
FIG. 13 depicts a perspective side view of a first antenna in accordance with an illustrative embodiment.
Figure 14:
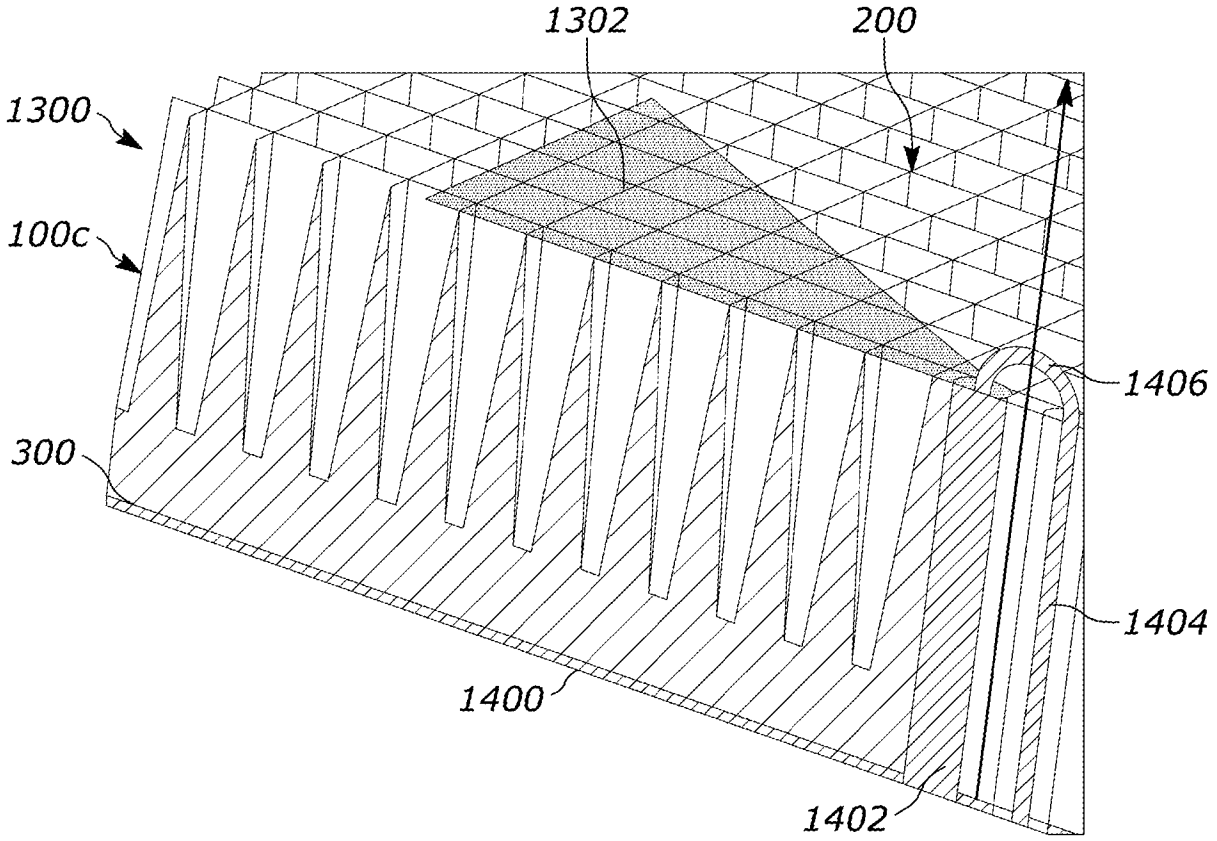
FIG. 14 depicts a side cross-sectional view of the first antenna of FIG. 13 in accordance with an illustrative embodiment.

Referring to FIG. 13, a perspective side view of a first antenna 1300 is shown in accordance with an illustrative embodiment. Referring to FIG. 14, a side cross-sectional view of first antenna 1300 is shown in accordance with an illustrative embodiment. First antenna 1300 may include a conducting layer 1400, a third dielectric element 100*c*, and a second pattern layer 1302. Third dielectric element 100*c* is similar to first dielectric element 100*a* except it includes 17 cells in both the x-direction and the y-direction, and third dielectric element 100*c* does not include the one or more element sidewalls 114. Second pattern layer 1302 is formed of a conductive material layered on top surface 200 to form a bowtie shaped conductive structure.

Conducting layer 1400 may be formed of a sheet of conductive material such as copper plated steel, silver plated steel, silver plated copper, silver plated copper clad steel, copper, copper clad aluminum, steel, etc. Conducting layer 1400 may be connected to a fixed potential that may be, but is not necessarily, a ground potential. Conducting layer 1400 may be generally flat or formed of ridges or bumps. For illustration, conducting layer 1400 may be formed of a flexible membrane coated with a conductor. Conducting layer 1400 is formed on bottom surface 300 of third dielectric element 100*c*.

A first vertical interconnect access (via) 1402 connects to second pattern layer 1302 through a cell of third dielectric element 100*c*. A second via 1404 connects to a wire 1406 connected to first via 1402 and second pattern layer 1302. Second via 1404 is also formed through a cell of third dielectric element 100*c*. Electrical energy is provided to second pattern layer 1302 through second via 1404 so that first antenna 1300 forms a bowtie antenna. As understood by a person of skill in the art, dimensions and/or materials associated with first antenna 1300 may be selected based on $\lambda_0$, a wavelength in free space at a center frequency selected for operation of first antenna 1300. Depending on a type of structure formed by second pattern layer 1302, one or more vias may be positioned at different locations.

First antenna 1300 was simulated using ANSYS HFSS, which is 3D electromagnetic simulation software for designing and simulating high-frequency electronic products, for first antenna 1300 selected to operate at a center frequency of 2.4 gigahertz (GHz). The simulated first antenna 1300 had top cell width 508 equal to 73.17 mils, bottom cell width 510 equal to 5 mils, cell depth 512 equal to 390 mils width 104 and height 106 equal to 1.93 inches, and a dielectric constant value of 2.17 Farad/meter.

Figure 15A:
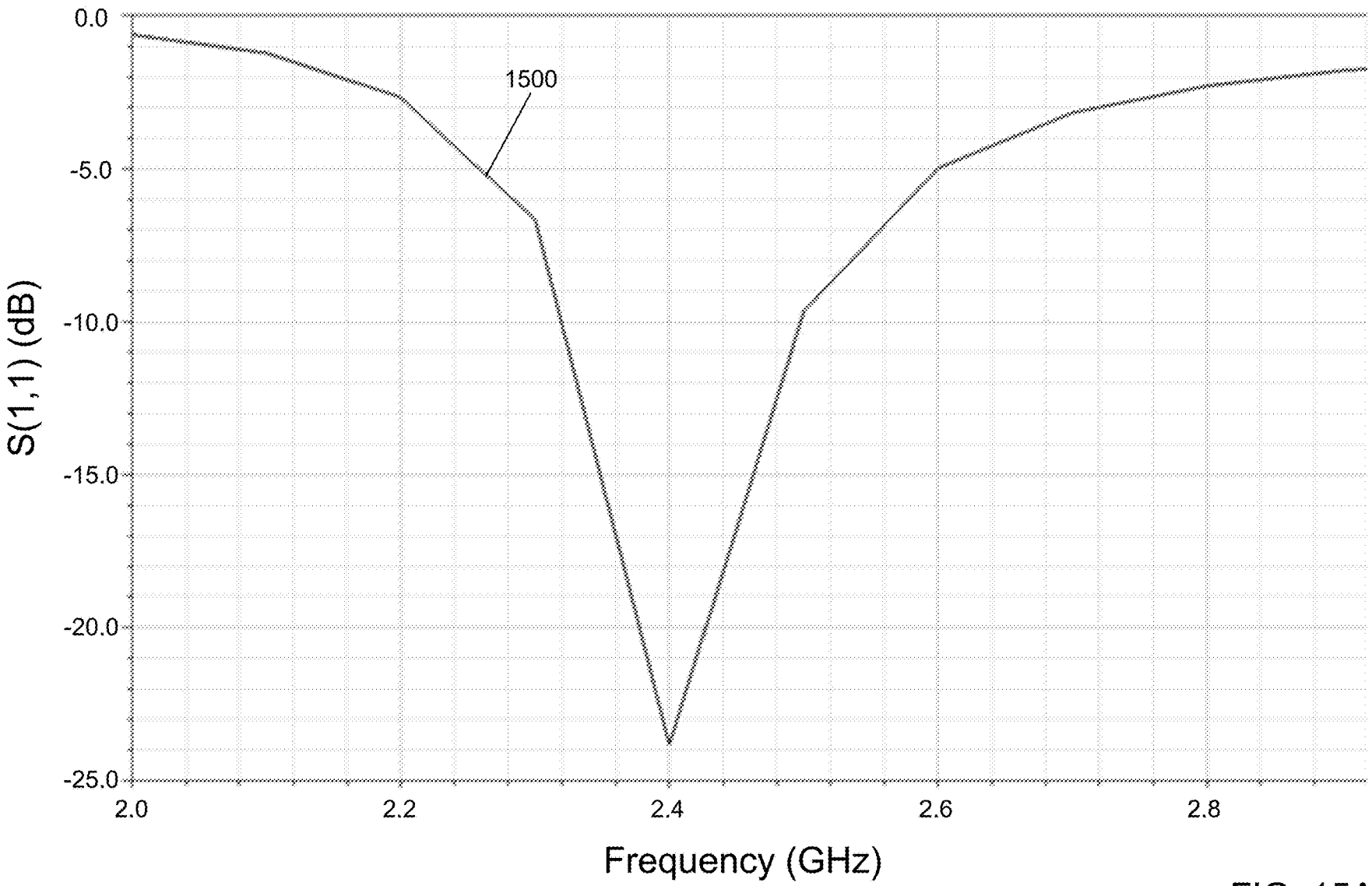
FIG. 15A depicts a simulated transmission coefficient of the first antenna of FIG. 13 as a function of frequency in accordance with an illustrative embodiment.
Figure 15B:
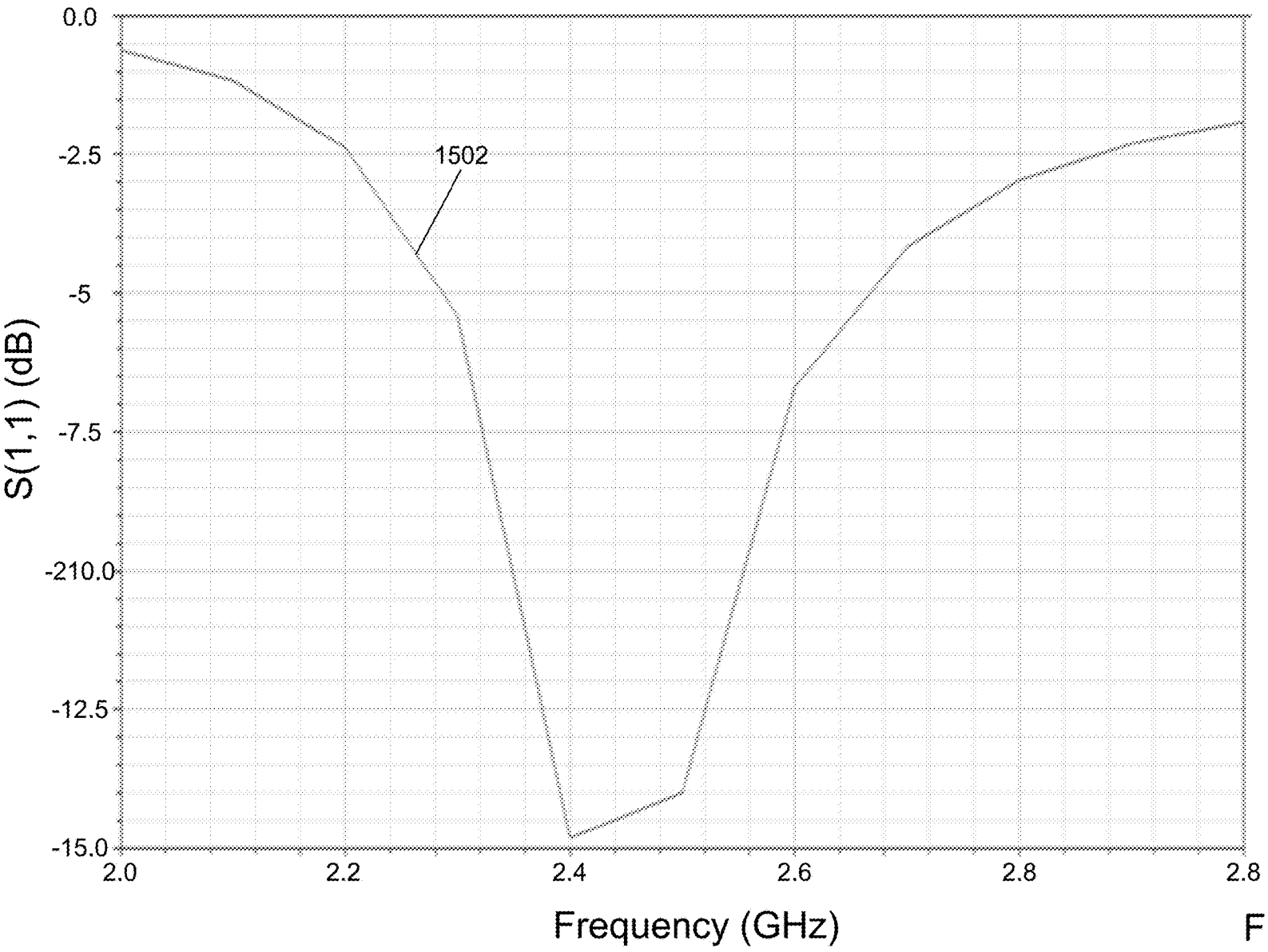
FIG. 15B depicts a simulated transmission coefficient of an antenna with a solid dielectric as a function of frequency in accordance with an illustrative embodiment.

Referring to FIG. 15A, a first transmission coefficient curve 1500 generated by the simulation for first antenna 1300 as a function of frequency is shown in accordance with an illustrative embodiment. Referring to FIG. 15B, a second transmission coefficient curve 1502 generated by the simulation for a solid dielectric antenna as a function of frequency is shown in accordance with an illustrative embodiment. Dimensions for the solid dielectric antenna were adjusted relative to first antenna 1300 to tune the solid dielectric antenna to the same frequency as first antenna 1300. The solid dielectric antenna used the same dielectric material as first antenna 1300. A comparison of first transmission coefficient curve 1500 with second transmission coefficient curve 1502 shows that first antenna 1300 resulted in excellent return loss, and third dielectric element 100*c* did not degrade the bandwidth.

Figure 16A:
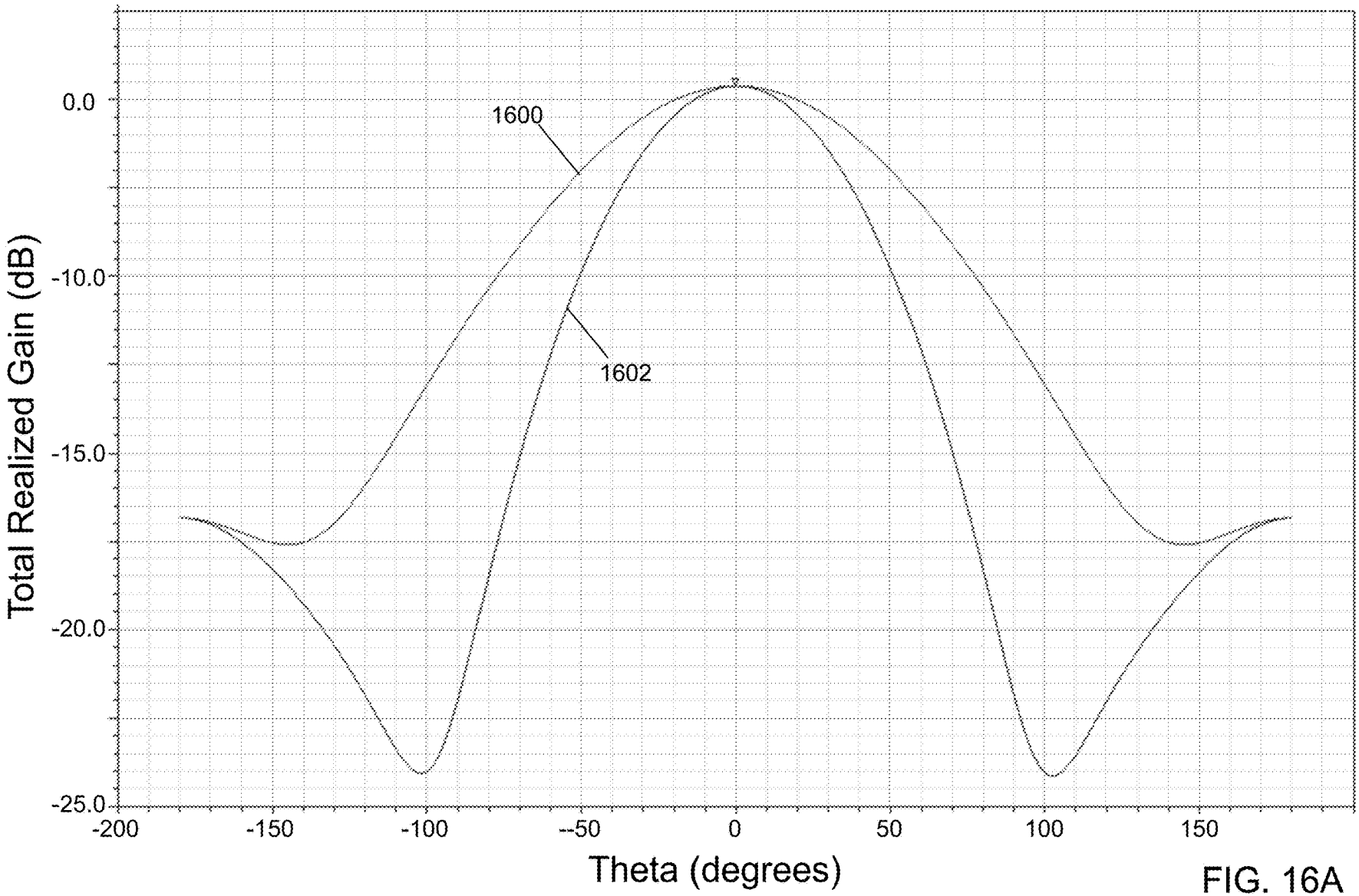
FIG. 16A depicts a simulated total realized gain of the first antenna of FIG. 13 as a function of theta angle in accordance with an illustrative embodiment.
Figure 16B:
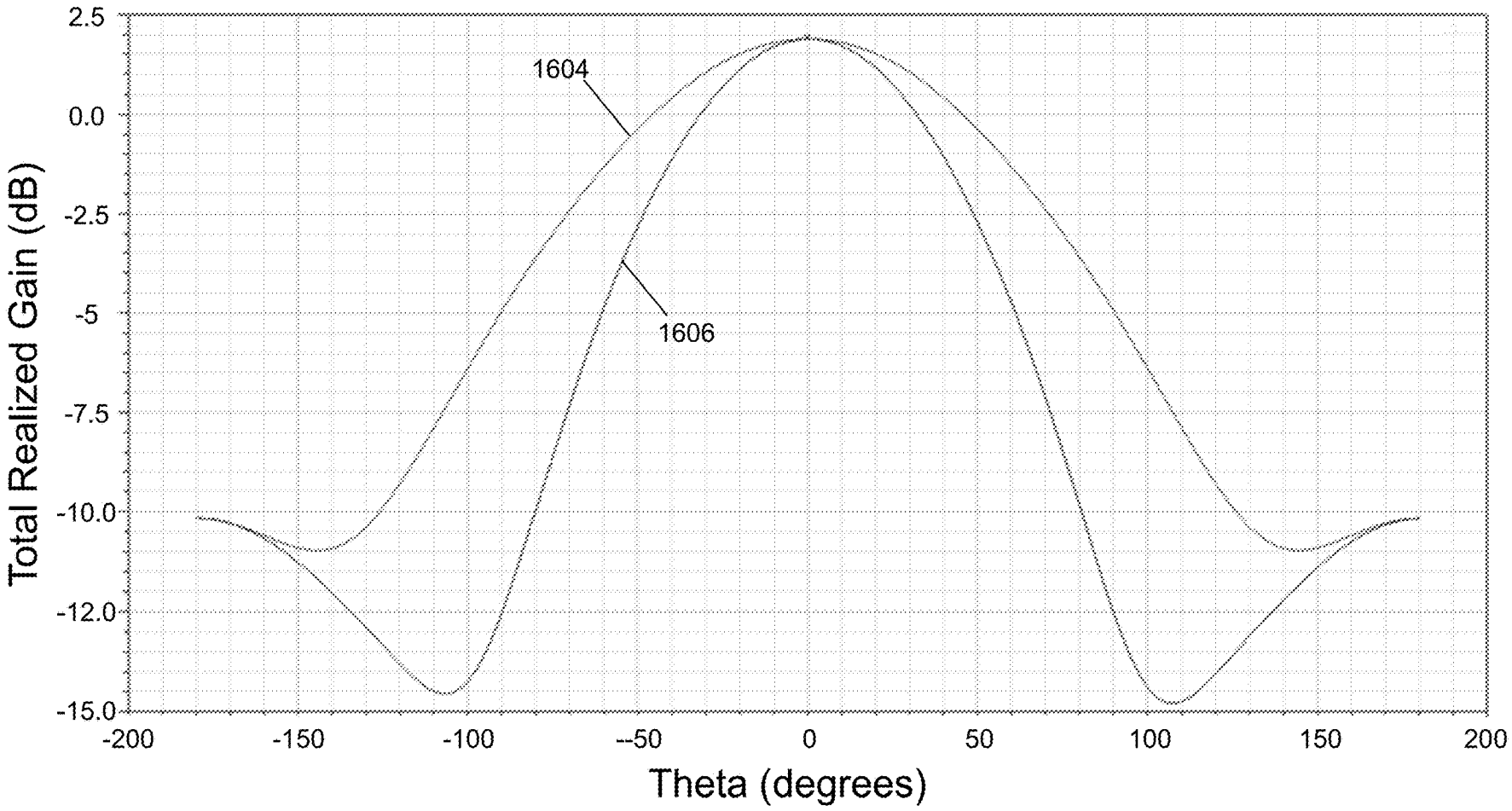
FIG. 16B depicts a simulated total realized gain of the antenna with the solid dielectric as a function of theta angle in accordance with an illustrative embodiment.

Referring to FIG. 16A, a first simulated realized gain for first antenna 1300 is shown as a function of the theta angle in accordance with an illustrative embodiment. Referring to FIG. 16B, a first simulated realized gain for the solid dielectric antenna is shown as a function of the theta angle in accordance with an illustrative embodiment. A first gain curve 1600 shows the gain for $\theta_0=0°$ for first antenna 1300. A second gain curve 1602 shows the gain for $\theta_0=90°$ for first antenna 1300. A third gain curve 1604 shows the gain for $\theta_0=0°$ for the solid dielectric antenna. A fourth gain curve 1606 shows the gain for $\theta_0=90°$ the solid dielectric antenna. The simulation predicted a peak realized gain of 2.8 dBi for first antenna 1300 in comparison to 1.9 dBi for the solid dielectric antenna. First gain curve 1600 and second gain curve 1602 in comparison to third gain curve 1604 and to fourth gain curve 1606, respectively, show that third dielectric element 100*c* did not affect the radiation pattern, and the effect on efficiency and gain were lower than when a solid dielectric was used.

Figure 17:
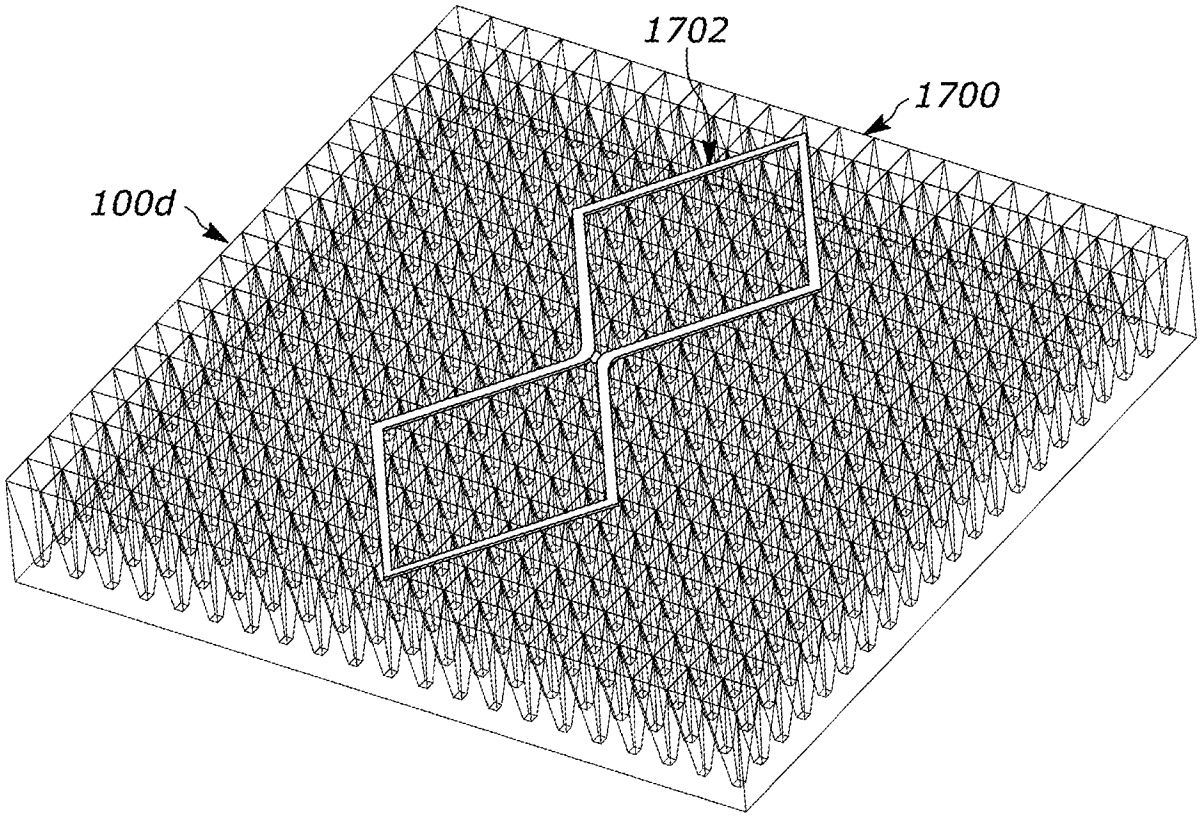
FIG. 17 depicts a perspective side view of a second antenna in accordance with an illustrative embodiment.

Referring to FIG. 17, a perspective side view of a second antenna 1700 is shown in accordance with an illustrative embodiment. Second antenna 1700 may include a conducting layer (not shown), a fourth dielectric element 100*d*, and a third pattern layer 1702. Fourth dielectric element 100*d* is similar to first dielectric element 100*a* except it includes 21 cells in both the x-direction and the y-direction. Third pattern layer 1702 is formed of a conductive material layered on top surface 200 to form a biquad shaped conductive structure. The conducting layer may be similar to conducting layer 1400 and one or more vias (not shown) may further be formed through fourth dielectric element 100*d* to provide electrical energy to third pattern layer 1702 so that second antenna 1700 forms a biquad antenna.

Figure 18:
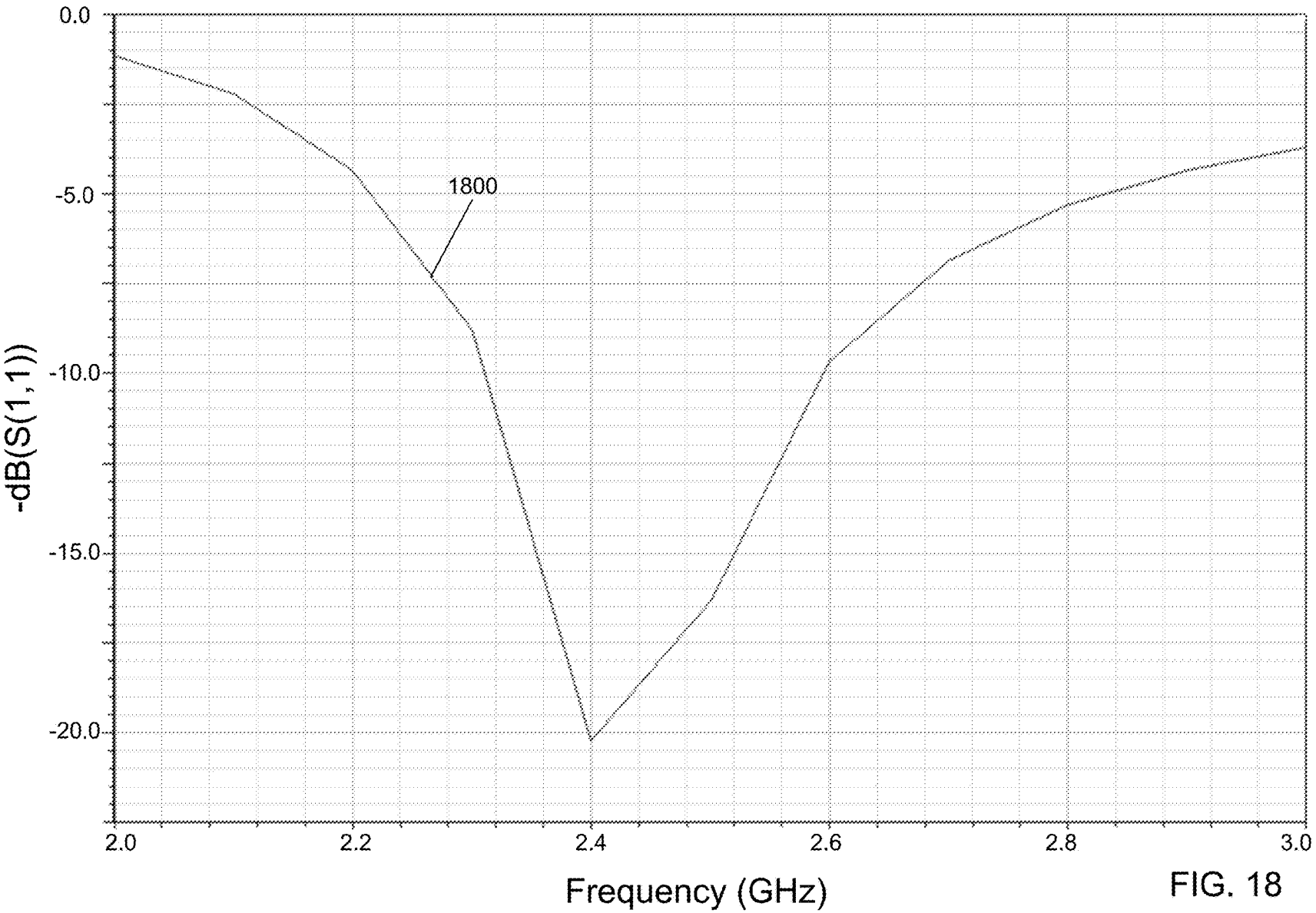
FIG. 18 depicts a simulated transmission coefficient of the second antenna of FIG. 17 as a function of frequency in accordance with an illustrative embodiment.

Referring to FIG. 18, a transmission coefficient curve 1800 generated by the simulation as a function of frequency is shown in accordance with an illustrative embodiment. Transmission coefficient curve 1800 shows that second antenna 1700 resulted in excellent return loss, and fourth dielectric element 100*d* did not degrade the bandwidth.

Figure 19:
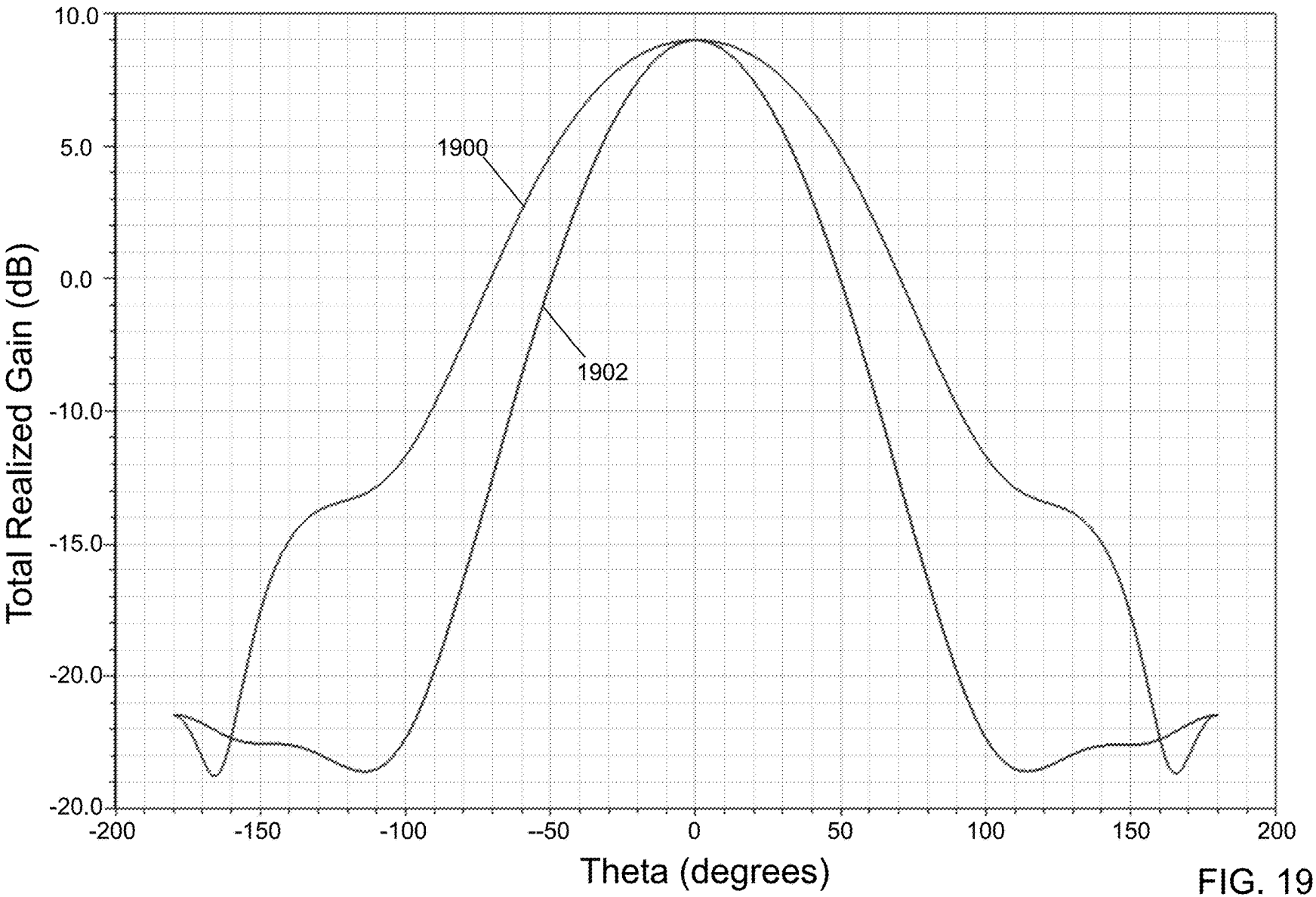
FIG. 19 depicts a simulated total realized gain of the second antenna of FIG. 17 as a function of theta angle in accordance with an illustrative embodiment.

Referring to FIG. 19, a simulated realized gain for second antenna 1700 is shown as a function of the theta angle in accordance with an illustrative embodiment. A first gain curve 1900 shows the gain for $\theta_0=0°$. A second gain curve 1902 shows the gain for $\theta_0=90°$. The simulation predicted a peak realized gain of 8.95 dBi. First gain curve 1900 and second gain curve 1902 show that fourth dielectric element 100*d* did not affect the radiation pattern, and the effect on efficiency and gain were lower than when a solid dielectric was used.

Figure 20:
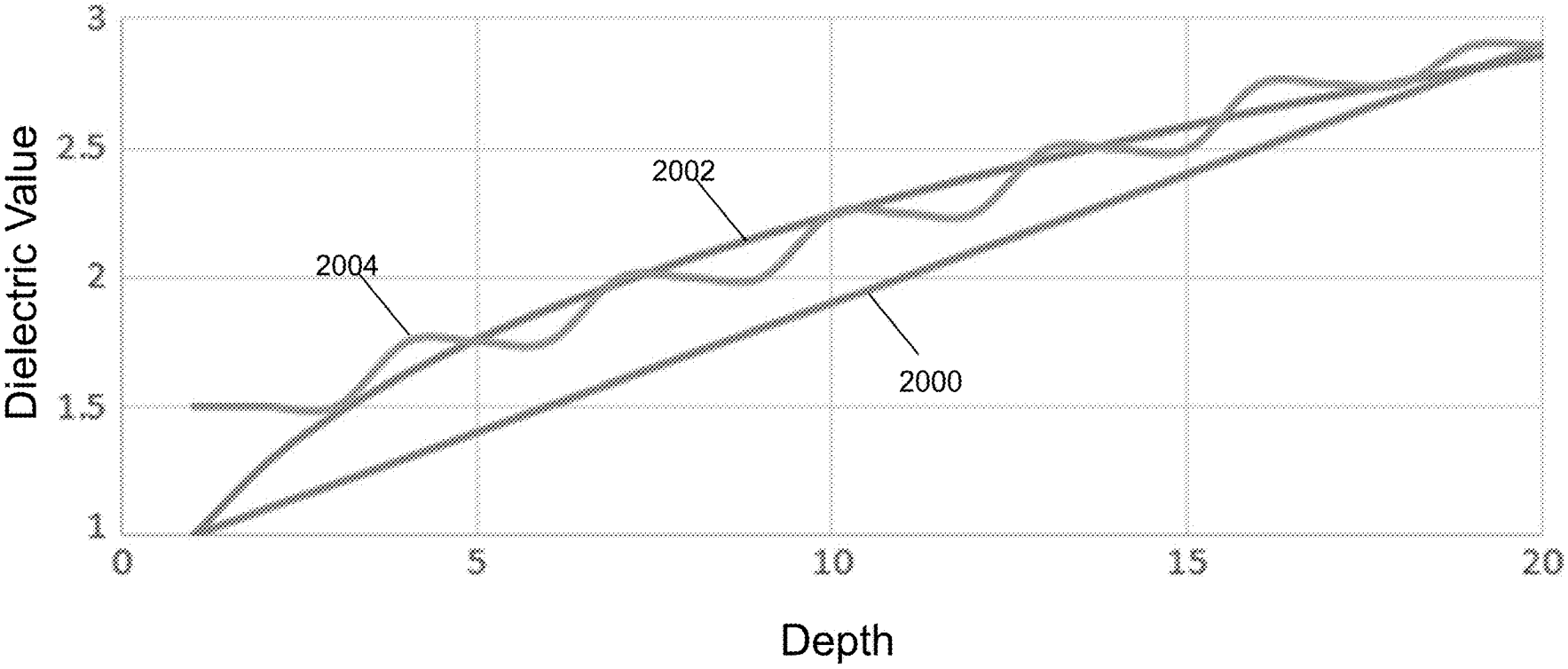
FIG. 20 depicts a dielectric value as a function of depth in accordance with an illustrative embodiment.

Referring to FIG. 20, a dielectric value as a function of depth is shown in accordance with an illustrative embodiment. A first dielectric curve 2000 shows the variation in dielectric value as a function of depth in the z-direction for linearly tapered walls as illustrated by first dielectric element 100*a*. A second dielectric curve 2002 shows the variation in dielectric value as a function of depth in the z-direction for curved walls as illustrated by second dielectric element 100*b*. A third dielectric curve 2004 shows the variation in dielectric value as a function of depth in the z-direction for cell sidewalls with stepped linear slopes. Though not shown, a stepped curved cell sidewall may be used in an alternative embodiment. The sidewall(s) of first dielectric element 100*a*, second dielectric element 100*b*, third dielectric element 100*c*, and/or fourth dielectric element 100*d* taper between top surface 200 and bottom surface 300. The taper may be stepped such that the slope, whether it is curved or linear, changes at discrete depths. In addition, the taper may change between linear and curved at discrete depths.

Figure 21:
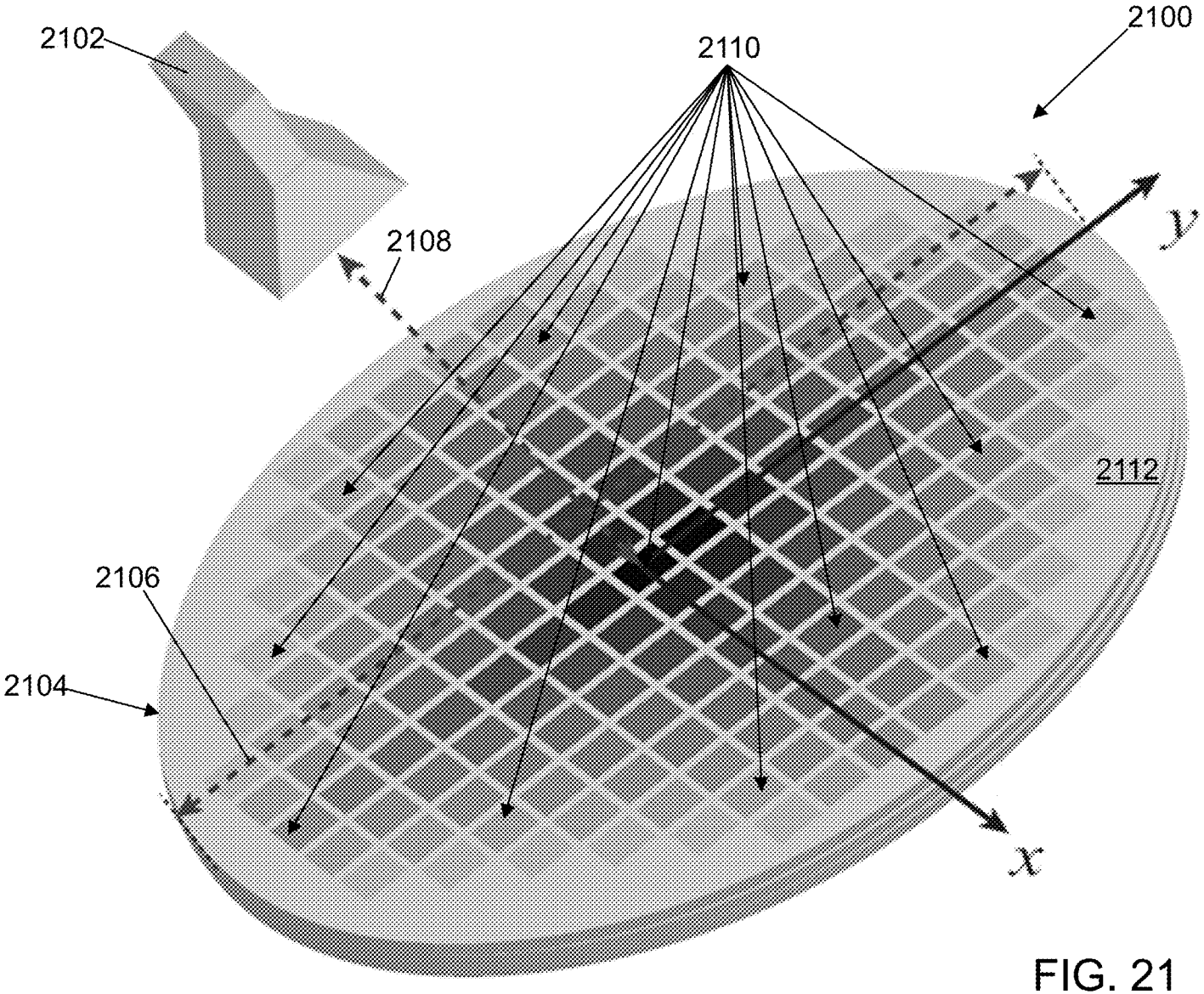
FIG. 21 depicts a perspective view of a first transceiver system in accordance with an illustrative embodiment.

Referring to FIG. 21, a perspective view of a transceiver system 2100 is shown with a circular aperture. Transceiver system 2100 may include a feed antenna 2102 and a reflective array antenna 2104 illuminated by feed antenna 2102. In the illustrative embodiment, feed antenna 2102 is a horn antenna positioned at a center of reflective array antenna 2104. Reflective array antenna 2104 may include a plurality of antenna elements 2110. For illustration, each antenna element of the plurality of antenna elements 2110 may be first antenna 1300 or second antenna 1700. The plurality of antenna elements 2110 are arranged to form a circular 2-D array though other shapes and arrangements may be used in alternative embodiments. Reflective array antenna 2104 has an aperture diameter 2106.

Transceiver system 2100 may act as a transmitter or a receiver of analog or digital signals.

Feed antenna 2102 may be a dipole antenna, a monopole antenna, a helical antenna, a microstrip antenna, a patch antenna, a fractal antenna, a horn antenna, a slot antenna, an end fire antenna, a parabolic antenna, etc. Feed antenna 2102 is positioned a focal distance 2108, $f_d$, from a top surface 2112 of reflective array antenna 2104. Feed antenna 2102 is configured to receive an analog or a digital signal, and in response, to radiate a spherical radio wave toward top surface 2112. Feed antenna 2102 also may be configured to receive the spherical radio wave from top surface 2112 and to generate an analog or a digital signal in response.

The plurality of antenna elements 2110 may be arranged to form a one-dimensional (1D) or a two-dimensional (2D) array in any direction. The plurality of antenna elements 2110 may form variously shaped apertures including circular, rectangular, square, elliptical, etc. The plurality of antenna elements 2110 can include any number of antenna elements.

The spherical radio wave reaches different portions of top surface 2112 at different times. The plurality of antenna elements can be considered to be a plurality of pixels each of which may provide a selected phase shift within the frequency band of interest. Thus, each antenna element of the plurality of antenna elements can be phase shifted such that the spherical radio wave is re-radiated in the form of a planar wave that is parallel to top surface 2112, or vice versa. Given aperture diameter 2106 and focal distance 2108, a phase shift profile to form the planar wave directed to a specific angle can be calculated as understood by a person of skill in the art.

Figure 22:
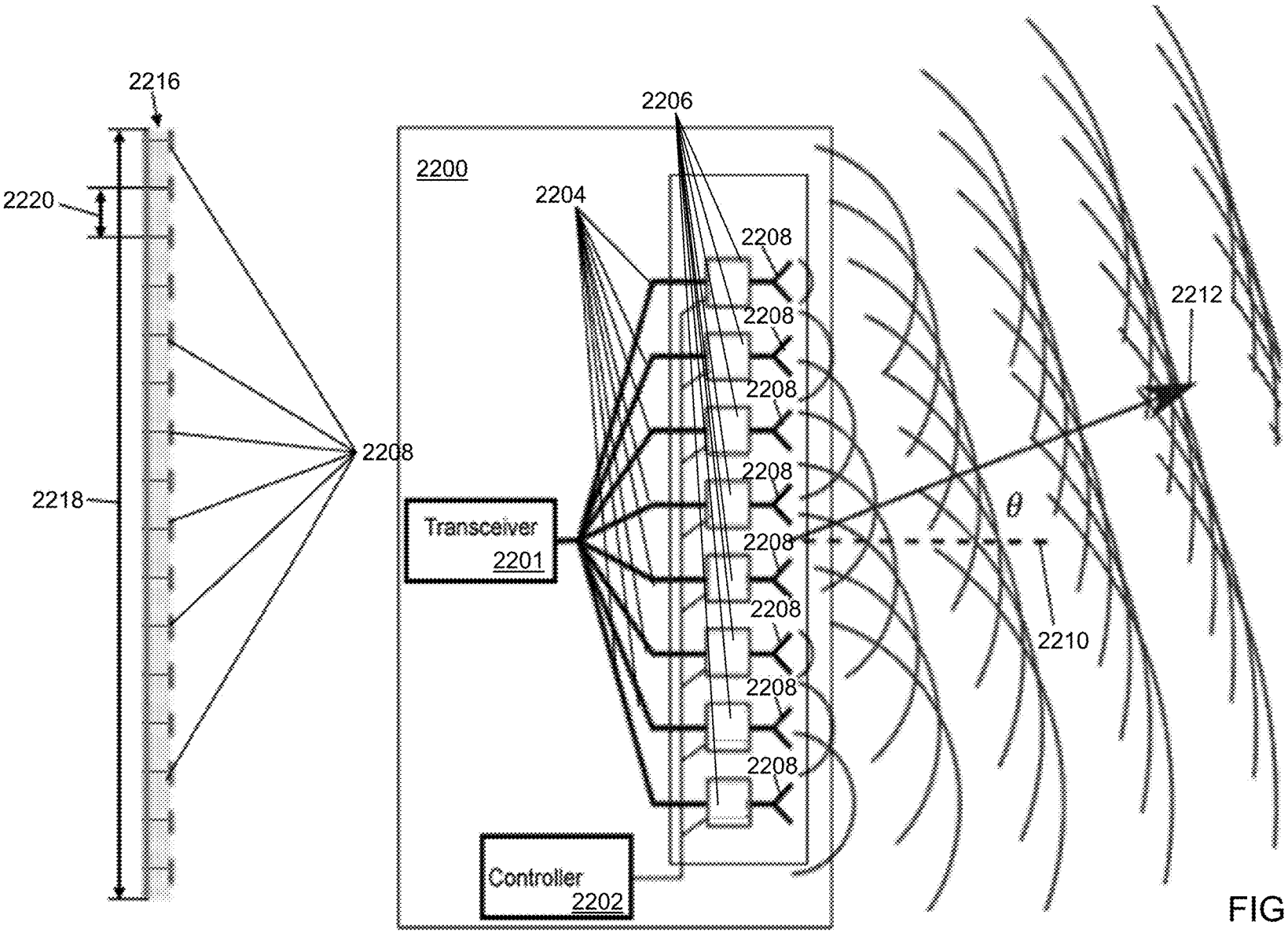
FIG. 22 depicts a side view of a second transceiver system in accordance with an illustrative embodiment.

Referring to FIG. 22, a one-dimensional (1D) side view of another transceiver system 2200 is shown in accordance with an illustrative embodiment. Transceiver system 2200 may include a transceiver 2201, a controller 2202, a feed line network 2204, a plurality of phase shifters 2206, and a plurality of antenna elements 2208. Transceiver system 2200 may act as a transmitter and/or a receiver of analog or digital signals. For illustration, each antenna element of the plurality of antenna elements 2208 may be first antenna 1300 or second antenna 1700 connected to a respective phase shifter.

The plurality of antenna elements 2208 is arranged to form a 1D or a 2D phased array antenna as shown on the left side. The phased array antenna has an aperture length 2218 in a vertical plane and may further have an aperture width (not shown) in a horizontal plane. A center of each antenna element of the plurality of antenna elements 2208 may be separated a distance 2220 from a center of each adjacent antenna element in any direction. The plurality of antenna elements 2208 include a dielectric layer formed of a plurality of dielectric elements such as first dielectric element 100*a*, second dielectric element 100*b*, third dielectric element 100*c*, and/or fourth dielectric element 100*d*.

As understood by a person of skill in the art, the phased array antenna can electronically change a pointing direction 2212 of a main beam relative to a boresight vector 2210 by changing a phase shift applied by each phase shifter to a respective antenna element under control of controller 2202. Controller 2202 thereby electronically steers the main beam to different directions without moving the phased array antenna. The electromagnetic energy associated with the electrical energy field input from transceiver 2201 is fed to each phase shifter of the plurality of phase shifters 2206 through feed line network 2204. Based on the pointing direction 2212 of the main beam selected, controller 2202 defines a phase shift value to be generated by each phase shifter of the plurality of phase shifters 2206. With the phase relationship defined by controller 2202 for each phase shifter of the plurality of phase shifters 2206, the radio waves from each of the antenna elements add together to increase the radiation in the pointing direction 2212, while canceling to suppress radiation in undesired directions. The lines from each antenna element represent a wave front of the electromagnetic waves emitted by each antenna element. The individual wave fronts are spherical, but they combine in front of the phased array antenna to create a plane wave, a beam of radio waves travelling in the pointing direction 2212.

As used herein, the term "mount" includes join, unite, connect, couple, associate, insert, hang, hold, affix, attach, fasten, bind, paste, secure, bolt, screw, rivet, solder, weld, glue, form over, form in, layer, mold, rest on, rest against, etch, abut, and other like terms. The phrases "mounted on", "mounted to", and equivalent phrases indicate any interior or exterior portion of the element referenced. These phrases also encompass direct mounting (in which the referenced elements are in direct contact) and indirect mounting (in which the referenced elements are not in direct contact, but are connected through an intermediate element). Elements referenced as mounted to each other herein may further be integrally formed together, for example, using a molding or a thermoforming process as understood by a person of skill in the art. As a result, elements described herein as being mounted to each other need not be discrete structural elements. The elements may be mounted permanently, removably, or releasably unless specified otherwise.

The word "illustrative" is used herein to mean serving as an example, instance, or illustration. Any aspect or design described herein as "illustrative" is not necessarily to be construed as preferred or advantageous over other aspects or designs. Further, for the purposes of this disclosure and unless otherwise specified, "a" or "an" means "one or more". Still further, using "and" or "or" in the detailed description is intended to include "and/or" unless specifically indicated otherwise. The illustrative embodiments may be implemented as a method, apparatus, or article of manufacture using standard programming and/or engineering techniques to produce software, firmware, hardware, or any combination thereof to control a computer to implement the disclosed embodiments.

Any directional references used herein, such as left side, right side, top, bottom, back, front, up, down, above, below, etc., are for illustration only based on the orientation in the drawings selected to describe the illustrative embodiments.

The foregoing description of illustrative embodiments of the disclosed subject matter has been presented for purposes of illustration and of description. It is not intended to be exhaustive or to limit the disclosed subject matter to the precise form disclosed, and modifications and variations are possible in light of the above teachings or may be acquired from practice of the disclosed subject matter. The embodiments were chosen and described in order to explain the principles of the disclosed subject matter and as practical applications of the disclosed subject matter to enable one skilled in the art to utilize the disclosed subject matter in various embodiments and with various modifications as suited to the particular use contemplated.

What is claimed is:

1. A dielectric element comprising:

a bottom surface;

a top surface; and a plurality of cells formed vertically between the bottom surface and the top surface, wherein each cell of the plurality of cells comprises:

a cell sidewall that extends below the top surface toward the bottom surface, wherein the cell sidewall forms an aperture in the top surface, wherein the cell sidewall tapers from the top surface toward a center of a respective cell, and wherein each cell sidewall is formed of a dielectric material.

2. The dielectric element of claim 1, wherein a dielectric constant of the dielectric material changes in a plane parallel to the top surface.

3. The dielectric element of claim 1, wherein a dielectric constant of the dielectric material changes in a plane perpendicular to the top surface.

4. The dielectric element of claim 1, wherein each cell sidewall is formed of a plurality of different dielectric materials, and wherein the dielectric material is one of the plurality of different dielectric materials.

5. The dielectric element of claim 1, further comprising an element sidewall formed between the bottom surface and the top surface surrounding the plurality of cells on at least one side.

6. The dielectric element of claim 5, wherein the element sidewall forms a polygon in a plane parallel to the top surface.

7. The dielectric element of claim 5, wherein the element sidewall forms an ellipse in a plane parallel to the top surface.

8. The dielectric element of claim 1, wherein each cell sidewall forms a polygon in a plane parallel to the top surface.

9. The dielectric element of claim 1, wherein each cell sidewall forms an ellipse in a plane parallel to the top surface.

10. The dielectric element of claim 1, wherein the taper of each cell sidewall is vertical.

11. The dielectric element of claim 1, wherein the taper of each cell sidewall has a linear slope between vertical and horizontal.

12. The dielectric element of claim 11, wherein the linear slope changes at discrete levels between the top surface and the bottom surface.

13. The dielectric element of claim 1, wherein the taper of each cell sidewall is curved.

14. The dielectric element of claim 13, wherein a curvature of the curved taper is defined by a polynomial.

15. The dielectric element of claim 13, wherein a curvature of the curved taper changes at discrete levels between the top surface and the bottom surface.

16. The dielectric element of claim 1, wherein the dielectric element is solid between the cell sidewalls of adjacent cells of the plurality of cells.

17. The dielectric element of claim 1, wherein the cell sidewall of each cell extends through the bottom surface to form a bottom aperture in the bottom surface.

18. An antenna comprising:

a dielectric element comprising:

a bottom surface;

a top surface; and a plurality of cells formed vertically between the bottom surface and the top surface, wherein each cell of the plurality of cells comprises:

a cell sidewall that extends below the top surface toward the bottom surface, wherein the cell sidewall forms an aperture in the top surface, wherein the cell sidewall tapers from the top surface toward a center of a respective cell, and wherein each cell sidewall is formed of a dielectric material;

a conductive layer including a top conductive surface and a bottom conductive surface, wherein the top conductive surface is on an opposite side of the first conductive layer relative to the bottom conductive surface, wherein the top conductive surface is mounted to the bottom surface of the dielectric element, and wherein the conductive layer is formed of a first conductive material;

a conducting pattern layer mounted to the top surface of the dielectric element, wherein the conducting pattern layer is formed of a second conductive material; and a plurality of vertical interconnect accesses (vias), wherein each via of the plurality of vias is formed of a third conductive material that extends through the dielectric element from the bottom surface to the top surface, wherein each via of the plurality of vias is connected to the conducting pattern layer, and wherein a first via is configured to provide a first voltage value to the conducting pattern layer and a second via is configured to provide a second voltage value, different than the first voltage value, to the conducting pattern layer.

19. The antenna of claim 18, wherein a dielectric constant of the dielectric material changes in a plane parallel to the top surface.

20. An antenna array comprising:

a transmitter;

a plurality of antennas mounted to a surface to form an array, wherein each antenna of the plurality of antennas is mounted to receive electrical energy from the transmitter, and wherein each antenna of the plurality of antennas comprises a dielectric element comprising:

a bottom surface;

a top surface; and a plurality of cells formed vertically between the bottom surface and the top surface, wherein each cell of the plurality of cells comprises:

a cell sidewall that extends below the top surface toward the bottom surface, wherein the cell sidewall forms an aperture in the top surface, wherein the cell sidewall tapers from the top surface toward a center of a respective cell, and wherein each cell sidewall is formed of a dielectric material;

a conductive layer including a top conductive surface and a bottom conductive surface, wherein the top conductive surface is on an opposite side of the first conductive layer relative to the bottom conductive surface, wherein the top conductive surface is mounted to the bottom surface of the dielectric element, and wherein the conductive layer is formed of a first conductive material;

a conducting pattern layer mounted to the top surface of the dielectric element, wherein the conducting pattern layer is formed of a second conductive material; and a plurality of vertical interconnect accesses (vias), wherein each via of the plurality of vias is formed of a third conductive material that extends through the dielectric element from the bottom surface to the top surface, wherein each via of the plurality of vias is connected to the conducting pattern layer, and wherein a first via is configured to provide a first voltage value to the conducting pattern layer and a second via is configured to provide a second voltage value, different than the first voltage value, to the conducting pattern layer under control of the transmitter.

* * * * *